US010384841B2

(12) United States Patent
Werbner

(10) Patent No.: US 10,384,841 B2
(45) Date of Patent: Aug. 20, 2019

(54) LIQUID EXTRACTION, STORAGE, AND DISPENSING SYSTEM AND METHOD OF USE

(71) Applicant: Norman Werbner Information Services, Inc., Long Key, FL (US)

(72) Inventor: Norman Werbner, Long Key, FL (US)

(73) Assignee: Norman Werbner Information Services, Inc., Long Key, FL (US)

( * ) Notice: Subject to any disclaimer, the term of this patent is extended or adjusted under 35 U.S.C. 154(b) by 0 days.

(21) Appl. No.: 15/637,975

(22) Filed: Jun. 29, 2017

(65) Prior Publication Data

US 2019/0002170 A1 Jan. 3, 2019

(51) Int. Cl.
*B65D 47/20* (2006.01)
*B65D 47/26* (2006.01)
(Continued)

(52) U.S. Cl.
CPC ..... *B65D 47/2006* (2013.01); *B65D 47/2031* (2013.01); *B65D 47/263* (2013.01);
(Continued)

(58) Field of Classification Search
CPC .. B67C 3/00; B67C 3/16; B65D 47/20; B65D 83/005; B65D 83/0055; B65D 83/0072;
(Continued)

(56) References Cited

U.S. PATENT DOCUMENTS 222,988 A 12/1879 Fairlamb
280,820 A 7/1883 Hickson
(Continued)

FOREIGN PATENT DOCUMENTS

CN 201849722 6/2011
FR 2066691 8/1971

OTHER PUBLICATIONS

Analytical Columns . . . Chromatography Specialists from the following webpage: http://www.analyticalcolumns.com/syringes/sge/sgesyringesmicrovol0.5-5.html; Printed on Jul. 19, 2013; 3 pages.

(Continued)

*Primary Examiner* — Paul R Durand
*Assistant Examiner* — Randall A Gruby
(74) *Attorney, Agent, or Firm* — Hovey Williams LLP

(57) ABSTRACT

A system for extracting a liquid from a container. The system comprises a liquid extraction member including a liquid extraction inlet and one or more liquid extraction outlets. The system additionally includes one or more storage vessels each defining a liquid storage inlet coupled in fluid flow communication with the extraction member via one of the liquid extraction outlets. The system additionally includes a pressure differential device operable to cause liquid to flow from the container, through the liquid extraction member, and into one or more of the storage vessels. Furthermore, the system includes one or more fluid restrictors associated with the liquid extraction member and configured to prevent fluid flow in at least one direction through the liquid extraction member to prevent liquid in the liquid extraction member from receding from the liquid extraction member back into the container.

21 Claims, 13 Drawing Sheets

(51) Int. Cl.

| | |
|---|---|
| ***B65D 83/00*** | (2006.01) |
| ***B65D 85/72*** | (2006.01) |
| ***B67D 1/00*** | (2006.01) |
| ***B67D 1/02*** | (2006.01) |
| ***B67D 1/10*** | (2006.01) |
| ***B67D 1/12*** | (2006.01) |
| *B65D 85/00* | (2006.01) |
| *B65D 47/00* | (2006.01) |

(52) U.S. Cl.
CPC ..... *B65D 83/0005* (2013.01); *B65D 85/72* (2013.01); *B67D 1/0007* (2013.01); *B67D 1/0012* (2013.01); *B67D 1/02* (2013.01); *B67D 1/102* (2013.01); *B67D 1/125* (2013.01); *B67D 1/1252* (2013.01); *B65D 47/00* (2013.01); *B65D 85/00* (2013.01); *B67D 2001/0093* (2013.01); *B67D 2001/0097* (2013.01)

(58) Field of Classification Search
CPC ..... B65D 83/0077; B65D 83/0038; B67D 3/0038; B67D 7/00; B67D 7/0227; B67D 7/02
USPC ..... 141/3, 20, 23–27
See application file for complete search history.

(56) References Cited

U.S. PATENT DOCUMENTS

RE10,643 E 9/1885 Elder
1,267,434 A 5/1918 MacPherson
1,611,440 A 12/1926 Haupt
1,613,898 A * 1/1927 Metcalf ..... F04B 9/14 137/322
1,950,137 A 3/1934 Dowe
2,050,686 A 8/1936 Wiggins
2,393,217 A 1/1946 Brewton
2,462,642 A * 2/1949 Jacobson ..... B65B 31/003 141/20
2,515,956 A 7/1950 Greenberg
3,015,419 A * 1/1962 Arnett ..... B67D 1/0007 137/571
3,109,566 A * 11/1963 Yetter ..... B05B 9/0805 141/20
3,168,278 A * 2/1965 Ogden ..... B60N 2/502 188/298
3,211,191 A * 10/1965 Honisch ..... B65B 3/32 141/20
3,419,174 A 12/1968 Engdahl
3,438,551 A * 4/1969 Belisle ..... B67D 1/0001 222/182
3,453,086 A * 7/1969 Harm ..... B01J 7/02 422/112
3,615,241 A * 10/1971 Low ..... G01N 1/38 141/23
3,862,701 A 1/1975 Strunc et al.
3,902,491 A 9/1975 Lajus
3,987,941 A 10/1976 Blessing
4,036,064 A 7/1977 Hydo
4,116,366 A 9/1978 Takenakashirma et al.
4,119,244 A 10/1978 Funke
4,120,425 A 10/1978 Bethurum
4,240,570 A 12/1980 Brown et al.
4,392,578 A 7/1983 Fipp et al.
4,597,422 A 7/1986 Kovacevich, Jr.
4,616,514 A 10/1986 Magnussen et al.
4,691,842 A 9/1987 Foures
4,787,890 A * 11/1988 Ufermann ..... A61J 15/00 222/204
4,957,220 A * 9/1990 Du ..... B67D 1/1247 222/129.1
5,188,257 A * 2/1993 Plester ..... B01J 7/02 141/20
5,299,408 A 4/1994 Dupont
5,350,587 A * 9/1994 Plester ..... B01J 7/02 222/386.5
5,454,268 A 10/1995 Kim
5,649,647 A * 7/1997 Kodarar ..... B67D 7/0205 222/204
5,770,158 A 6/1998 Eischen et al.
5,770,160 A 6/1998 Smith et al.
5,848,222 A 12/1998 Jung
5,873,861 A 2/1999 Hitchins et al.
6,095,206 A * 8/2000 Jones ..... B65B 3/32 137/428
6,105,803 A 8/2000 Standish
6,168,761 B1 1/2001 Kelly et al.
6,170,715 B1 1/2001 Evans
6,290,105 B1 9/2001 Cosentino
6,352,673 B1 3/2002 Rainin et al.
6,365,110 B1 4/2002 Rainin et al.
6,576,295 B2 * 6/2003 Tisone ..... B01L 3/0265 427/256
7,051,901 B2 5/2006 Hickert
7,077,273 B2 7/2006 Ellsworth et al.
7,541,068 B2 * 6/2009 Tisone ..... B01L 3/0265 427/427.2
7,641,076 B2 * 1/2010 Nishida ..... B67D 1/0004 141/18
7,815,865 B2 10/2010 Hoffman et al.
8,220,660 B2 * 7/2012 Smith ..... G05D 11/006 137/101.19
8,261,781 B2 9/2012 Imai et al.
9,133,943 B2 * 9/2015 Ohmura ..... F16K 11/0565
9,382,106 B2 * 7/2016 Werbner ..... B67D 1/0885
2002/0088827 A1 7/2002 Colucci
2007/0039977 A1 2/2007 Donaldson
2007/0119875 A1 5/2007 Ehret et al.
2007/0138212 A1 6/2007 Greenbaum
2007/0164058 A1 7/2007 Burkovskiy
2008/0110847 A1 5/2008 Rees et al.
2009/0081772 A1 3/2009 Cayre
2009/0274793 A1 11/2009 Schroeder
2010/0108182 A1 5/2010 Noonan
2010/0206900 A1 8/2010 Dobrusskin et al.
2011/0039329 A1 2/2011 Gandy
2011/0088493 A1 4/2011 Blumentritt et al.
2011/0168175 A1 * 7/2011 Dunne ..... A61M 11/02 128/203.12
2011/0290826 A1 12/2011 Harris
2010/2041476 9/2012 Lambrecht
2013/0206281 A1 * 8/2013 Carroll ..... G01F 11/021 141/311 R
2014/0001215 A1 1/2014 Leckebusch
2014/0360622 A1 * 12/2014 Heatley ..... B65B 31/003 141/20
2017/0203056 A1 * 7/2017 Dunne ..... B05B 11/0054

OTHER PUBLICATIONS

Gastight Syringes from the following webpage: http://www.hamiltoncompany.com/products/syringes/c/794/; Hamilton Company; Printed on Jul. 19, 2013; 2 pages.
7000 Series Modified Microliter Syringe; Hamilton Company, Reno, Nevada; Document No. 69065(Rev. F); Jul. 2007; 3 pages.
Syringe Selection Guide; Hamilton Company, Reno, Nevada, 13 pages.
Search Report and Written Opinion dated Jun. 16, 2015 for related PCT Application No. PCT/US2014/047240, 13 pages.
Preliminary Report on Patentability dated Jan. 28, 2016 for related PCT Application PCT/US2014/047240, 12 pages.
Search Report and Written Opinion dated May 15, 2015 for corresponding PCT Patent Application No. PCT/US2014/047226; 12 pages.
Wine Pipette for Sampling Wine, www.homebrewwest.ie/wine-pipette-for-sampling-wine-1239-p.asp, published Feb. 22, 2011, accessed Nov. 25, 2015.

* cited by examiner

LIQUID EXTRACTION, STORAGE, AND DISPENSING SYSTEM AND METHOD OF USE

FIELD OF THE INVENTION

The invention relates generally to the extraction of liquids from a container. More particularly, the invention relates to apparatuses and methods for extracting liquids from a container, storing the liquids, and dispensing the liquids, while minimizing exposure of the liquids to an external environment.

BACKGROUND OF THE INVENTION

The shelf life and/or usefulness of certain liquids can deteriorate upon exposure to environmental components external to the container storing the liquid. For example, the shelf life of wine significantly decreases upon being exposed to ambient air because chemicals in the wine can be oxidized by the air, which can alter the wine's taste. In addition to wine, other liquids that are stored in sealed containers can also be oxidized or otherwise affected by exposure to the air. Current liquid extraction and/or liquid preservation devices attempt to alleviate these problems in a variety of ways; however, some are difficult to operate and may not provide an adequate solution for dispensing liquid from a container without introducing excess air into the remaining liquid. Therefore, there is a need for a liquid extraction apparatus and method that can successfully extract and store liquid to increase its shelf life and/or usefulness.

SUMMARY OF THE INVENTION

In one embodiment of the present invention, there is provided a system for extracting a liquid from a container having an opening, the system comprises a liquid extraction member including a liquid extraction inlet and one or more liquid extraction outlets. The liquid extraction member is configured for insertion through the opening of the container and for positioning of the extraction inlet below a surface of the liquid. The system additionally includes one or more storage vessels each defining a liquid storage inlet coupled in fluid flow communication with the extraction member via one of the liquid extraction outlets, with each of the storage vessels comprising a variable internal storage volume. The system additionally includes a pressure differential device operable to cause liquid to flow from the container, through the liquid extraction member, and into one or more of the storage vessels. Furthermore, the system includes one or more fluid restrictors associated with the liquid extraction member and configured to prevent fluid flow in at least one direction through the liquid extraction member to prevent liquid in the liquid extraction member from receding from the liquid extraction member back into the container.

In another embodiment of the present invention, there is provided a process for extracting liquid from a container. The process comprising the initial step of inserting a liquid extraction member into the container to a depth such that a liquid extraction inlet of the liquid extraction member extends below a surface of the liquid in the container. An additional step includes priming the liquid extraction member by creating a pressure differential between the extraction inlet and an extraction outlet of the liquid extraction member to thereby cause liquid to flow from the container into the liquid extraction member at least as far as at least one of the liquid extraction outlets. An additional step includes preventing liquid within the extraction member from receding from the liquid extraction member back into the container. The preventing step is performed by one or more fluid restrictors associated with the liquid extraction member. A further step includes drawing the liquid held within the liquid extraction member into a storage vessel fluidly connected with the liquid extraction outlet of the liquid extraction member. The liquid drawn into the storage vessel during the drawing step does not make direct contact with ambient air.

BRIEF DESCRIPTION OF THE FIGURES

Certain embodiments of the present invention are described herein with reference to the following drawing figures, wherein.

DETAILED DESCRIPTION

The following detailed description of the invention references various embodiments. The embodiments are intended to describe aspects of the invention in sufficient detail to enable those skilled in the art to practice the invention. Other embodiments can be utilized and changes can be made without departing from the scope of the present invention. Further, it should be understood that the below described embodiments are not exclusive of one another, and any portion of the description, properties, and parameters of any one embodiment can be combined with any portion of the description, properties, and parameters of any other embodiment. Also, unless specifically stated otherwise, steps of the methods and processes described herein may be performed in various orders, with such orders potentially being different from the explicitly described order. Furthermore, some steps may be performed concurrently as opposed to sequentially. Furthermore still, some steps may be optional. The following detailed description is, therefore, not to be taken in a limiting sense. The scope of the present invention is defined only by the appended claims, along with the full scope of equivalents to which such claims are entitled.

Figure 1:
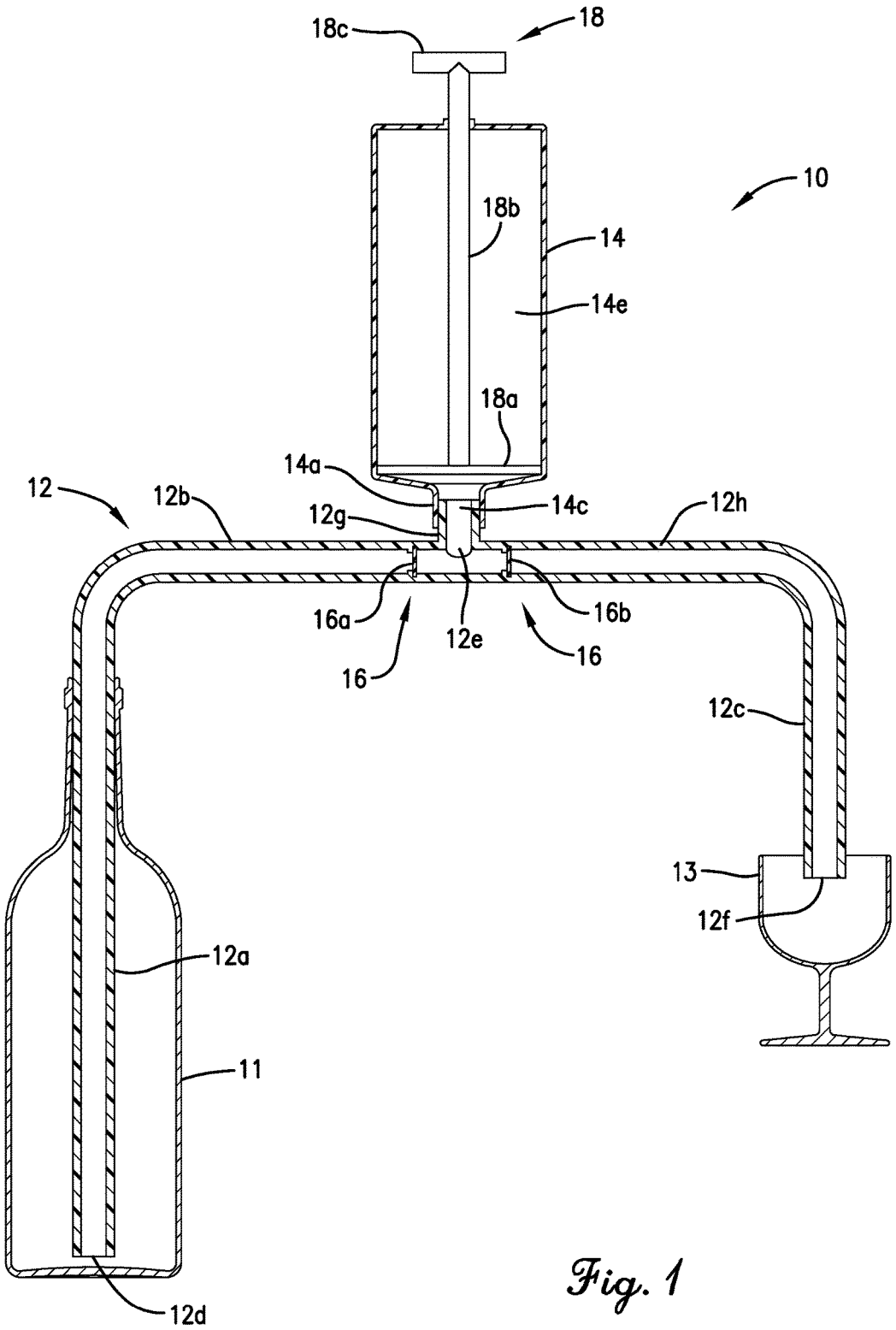
FIG. 1 is an elevational cross-sectional view of a liquid extraction apparatus in accordance with one embodiment of the present invention, particularly illustrating a segmented liquid extraction member partly received inside a container, a pressure differential device comprising a shiftable plunger partly received inside a storage vessel located above the container, and first and second valves received inside the extraction member.

FIG. 1 depicts one embodiment of a liquid extraction apparatus 10 in accordance with the present invention. It should be understood that the figures only depict some embodiments of a liquid extraction apparatus, and that a wide variety of embodiments of liquid extraction apparatuses are contemplated by the present invention, certain of which will be described in detail below. The liquid extraction apparatus 10 of FIG. 1 will now be described in detail.

The liquid extraction apparatus 10 of FIG. 1 is capable of extracting a liquid from a container 11 having an opening that provides access the interior of the container 11. To accomplish such extraction, the liquid extraction apparatus 10 of FIG. 1 broadly comprises a liquid extraction member 12, a storage vessel 14, one or more valves 16, and a pressure differential device 18. In certain embodiments, the liquid extraction apparatus 10 will have some of the same features, attributes, and functionalities of the inventive concepts disclosed in U.S. patent application Ser. No. 13/946,181, filed on Jul. 19, 2013, which is herein incorporated by reference in its entirety.

The container 11 from which the liquid is extracted by the liquid extraction apparatus 10 can be any container suitable to contain or store a liquid. In certain embodiments, the container 11 can be a container for storing perishable liquids. In one or more embodiments, the container 11 can be a wine bottle. The liquid can be any liquid where it is desirable to extract such liquid from the container 11 with minimal to no contact with the external environment. In certain embodiments, the liquid can be a perishable consumable liquid, such as, for example, wine, juice, milk, or a medicament. In one or more embodiments, the container 11 can be a wine bottle, and the liquid can be wine. In certain other embodiments, the liquid can be a non-consumable liquid, such as, for example, industrial chemicals, or household chemicals.

In certain embodiments, the liquid extraction member 12 can be made of any material that is suitable for contacting a specific liquid stored in the container 11, such as, for example, stainless steel, glass, plastic, silicone or rubber-like material. In one or more embodiments, the liquid extraction member 12 can be coated in a substance that is suitable for contacting a specific liquid stored in the container 11. The liquid extraction member 12 can be any size and shape as long as a portion of the extraction member 12 can be inserted into the container 11 and be positioned below a surface of the liquid inside the container 11. In certain embodiments, the liquid extraction member 12 may be shaped as a hollow cylinder. As such, the liquid extraction member 12 will present an interior volume for holding and transporting liquid. Nevertheless, it should be understood that the extraction member 12 is not necessarily required to have a cylindrical or a circular shape. For instance, the extraction member 12 may be shaped as a hollow polygon, such as a pentagon, hexagon, or the like. In certain embodiments, as described in more detail below, the liquid extraction member 12 will be used with a container 11 in the form of a standard bottle of wine. In such embodiments, the liquid extraction member 12 may have an inner diameter of between 0.25 and 1.25 inches, between 0.50 and 1.00 inches, or about 0.75 inches.

In some embodiments, such as illustrated in FIG. 1, the extraction member 12 may have a segmented shape. Specifically, the extraction member 12 may comprise an extraction section 12*a*, a transference section 12*b*, and a dispenser section 12*c*. The extraction section 12*a*, transference section 12*b*, and dispenser section 12*c* are each illustrated in FIG. 1 as extending generally linearly; however, each of said sections may extend non-linearly. In certain embodiments, the extraction section 12*a* may be positioned generally vertically so as to be configured for insertion into the container 11 in which liquid is being held. The liquid extraction member 12 may include a liquid extraction inlet 12*d* presented at a free end of the extraction section 12*a*, which is configured for being positioned below the surface of the liquid in the container 11. In embodiments in which the container 11 is a standard bottle of wine, the extraction section 12*a* may be sized so as to be received within the wine bottle. For example, the extraction section 12*a* may have an inner diameter of between 0.125 and 1.50 inches, between 0.25 and 1.25 inches, between 0.50 and 1.00 inches, or about 0.75 inches. In addition, the extraction section 12*a* may have a length of between 8 and 20 inches, between 10 and 15 inches, or about 12 inches.

The transference section 12*b* may extend at an angle from the extraction section 12*a*. In some embodiments, the transference section 12*b* may extend generally perpendicularly from the extraction section 12*a*, such that the transference section 12*b* extends generally horizontally. In other embodiments, the transference section 12*b* may extend at other angles from the extraction section 12*a* and/or may extend non-horizontally. The transference section 12*b* may include a liquid extraction outlet 12*e* that is presented by a surrounding connection member 12*g* extending from the transference section 12*b*. As such, the extraction member 12 may be configured to have the storage vessel 14 coupled thereto via the connection member 12*g*. In the embodiment depicted in FIG. 1, the connection member 12*g* extends from a sidewall 12*h* of the transference section 12*b* of the extraction member 12. As illustrated in the drawings, some embodiments provide for the connection member 12*g* to extend upward from the sidewall 12 of the transference section 12*b*, such that the connection member 12*g* extends in generally opposite direction from the extraction section 12*a*. In other embodiments, the connection member 12*g* may extend in other directions from the sidewall 12*h*, such as downwards, so that the connection member 12*g* extends in generally the same direction as the extraction section 12*a*. In further alternatives, the connection member 12*g* may extend from the sidewall 12*h* at any other angle between the upward and downward directions. In one or more embodiments, the connection member 12*g* may not extend outwardly from the extraction member 12, but may be formed as part of the sidewall 12*h*. In some embodiments, the connection member 12*g* and the liquid 12*e* may be centrally positioned on a length of the transference section 12*b*. However, as discussed below, the connection member 12*g* may be located at other positions on the extraction member 12.

The dispenser section 12*c* may extend at an angle from the transference section 12*b* and may be configured for directing liquid from the liquid extraction member 12, via a liquid dispensing outlet 12*f*, into a receptacle 13, such as a wine glass. In some embodiments, the dispenser section 12*c* may extend generally perpendicularly from the transference section 12*b*, such that the dispenser section 12*c* extends generally vertically. In other embodiments, however, the dispenser section 12*c* may extend at other angles from the transference section 12*b* and/or may extend non-vertically. It should be understood that although certain embodiments detailed herein describe the extraction member 12 being segmented, embodiments of the present invention provide for the sections (i.e., 12*a*, 12*b*, and 12*c*) of the extraction member 12 to extend in a non-segmented shape, such as by extending in a continuous and/or curvilinear shape.

In some embodiments of the present invention, the storage vessel 14 can be configured in any rigid size or shape, and a particular size and shape can be chosen by one skilled in the art. In certain embodiments, such as the embodiment depicted in FIG. 1, the storage vessel 14 has a cylindrical shape. As such, the storage vessel 14 defines an internal storage chamber 14*e* having a volume for storing liquid. In one or more embodiments, the volume presented by the internal storage chamber 14*e* may be at least 0.1 liters, 0.25 liters, or 0.4 liters, and/or not more than 5 liters, 4 liters, or 3 liters. In certain specific embodiments, the storage vessel 14 may be sized for containing a volume of liquid comparable to a standard wine bottle, such as 750 ml or the storage vessel 14 may be sized for containing a volume of liquid between 375 ml and 750 ml. The storage vessel may be formed from various materials suited for holding liquids, such as glass, plastic material, metal, or the like.

As illustrated in the embodiment depicted in FIG. 1, the storage vessel 14 may be coupled in fluid flow communication with extraction member 12. As such, the storage vessel 14 may include a connection member 14*a* operable to connect with the connection member 12*g* of the extraction member 12. The connection member 14*a* presents a through-opening 14*c* allowing for liquid to flow into the storage vessel 14 from the extraction member 12. In some embodiments, such as illustrated in FIG. 1, the storage vessel 14 can be secured to the transference section 12*b* of the extraction member 12, via the centrally-positioned connection member 12*g*, such that the storage vessel 14 is likewise positioned centrally with respect to the length of the transference section 12*b*. However, in other embodiments, the connection member 12*g* can be located at other positions about the extraction member 12, such that the storage vessel 14 may likewise be connected to the extraction member 12 at the location of the connection member 12*g*. Nevertheless, it may be preferable to attach the storage vessel 14 generally near a central portion of the transference section 12*b*, such that the storage vessel 14 can be positioned vertically and can remain connected to the extraction member 12 when the extraction section 12*a* of the extraction member 12 is inserted into the container 11. As illustrated in FIG. 1, the storage vessel 14 may be positioned in a vertically-upward orientation, such that the storage vessel 14 extends in a generally opposite direction from the extraction section 12*a*. Alternatively, the storage vessel 14 may be positioned in a vertically-downward orientation (See, e.g., FIGS. 4-5), such that the storage vessel 14 extends in generally the same direction as the extraction section 12*a*. In even further alternatives, in keeping alignment with the connection member 12*g*, the storage vessel 14 may extend at other angles from the transference section 12*b*, such that the storage vessel 14 may be positioned at any angle between the upward and downward directions.

The connection members 12*g* and 14*a* of the extraction member 12 and the storage vessel 14, respectively, can include any type of connection device or mechanism as long as the through-opening 14*c* permits liquid to flow from the extraction member 12 into the storage vessel 14. For example, in certain embodiments, the connection members 12*g* and 14*a* can be connected by complimentary threaded portions. In other embodiments, the connection members 12*g* and 14*a* can be connected by a friction-fit connection, a snap-fit connection, threaded connection, or the like.

The one or more valves 16 can be any type of device(s) capable of controlling the flow of liquid through the extraction member 12. For example, the valves 16 can include various types of check valves, such as one-way check valves (e.g., ball check-valves, diaphragm valves, duckbill valve, mushroom valve or the like), electrically/manually switched valves (e.g., swing check-valves, shut-off check-valves (i.e., stop check-valves), pinch valves, etc.), or the like. In certain embodiments, such as illustrated in FIG. 1, the extraction member 12 will include a first valve 16*a* spaced apart from a second valve 16*b*. In certain embodiments, the first and second valves 16*a*, 16*b* will be positioned so as to allow liquid to flow only in a single direction through the extraction member 12. In particular, the first and second valves 16*a*, 16*b* may allow liquid to flow in a direction from the container 11 to the receptacle 13 (i.e., from left to right as illustrated in FIG. 1). In some embodiments, the first and second valves 16*a*, 16*b* may be spaced apart within the extraction member 12, with each positioned on an opposite side of the connection member 12*g*. The valves 16*a*, 16*b* may be spaced apart as far as required; though, in some embodiments, it may be preferable for the valves 16*a*, 16*b* to only be spaced apart as far as necessary to allow liquid to flow into the through-opening 14*c* of the storage vessel 14. In alternative embodiments, the first and second valves 16*a*, 16*b* may be replaced by a single multi-way valve (e.g., a three-way valve) positioned adjacent to the connection member 12*g*. Such a multi-way valve may be configured, for instance, to allow liquid to flow only (1) from the container 11 into the storage vessel 14, or (2) from the storage vessel 14 to the receptacle 13.

The pressure differential device 18 may be shiftably disposed in the storage vessel 14. The pressure differential device 18 can be any device capable of generating a pressure differential between the liquid extraction apparatus 10 and the container 11, and a specific device can be chosen by one skilled in the art for a particular purpose. In the embodiment depicted in FIG. 1, the pressure differential device 18 may be a shiftable plunger comprising a base portion 18*a*, a shaft 18*b* extending from the base portion 18*a*, and a handle 18*c* secured to the shaft 18*b* opposite the base portion 18*a*. The base portion 18*a* can include any flexible or rigid material that is capable of creating a pressure differential so as to draw liquid into the storage vessel 14 from the extraction member 12 and the container 11. In such embodiments, the base portion 18*a* can be sized to correspond with the internal storage chamber 14*e* of the storage vessel 14 and can be formed form any material or combination of materials capable of creating a fluid seal within the storage vessel 14, i.e., by preventing air and/or liquid from passing through or around the base portion 18*a*, such as, for example, silicone, rubber, and/or a rubber-like material. In some embodiments, the base portion 18*a* may be formed from a generally solid disc of plastic or metal in combination with a rubber o-ring or other seal formed around the perimeter of the disc. As such, the base portion 18*a* may be configured to act as a shiftable barrier that is capable of preventing air and/or liquid from entering into the storage vessel 14 and/or from passing from one side of the base portion 18*a* to the other. In alternative embodiments, some of which are described in more detail below (See, e.g., FIGS. 4-6), the pressure differential device 18 may comprise a shiftable barrier that can be controlled with an actuator, a pump (e.g., an air or a hydraulic pump), or other similar mechanism.

Given the liquid extraction apparatus 10 discussed above, to extract liquid from the container 11, the extraction section 12*a* of the extraction member 12 can be inserted into the container 11 so that the extraction inlet 12*d* is positioned below the surface of the liquid in the container 11. Additionally, portions of the pressure differential device 18 will be positioned within the storage vessel 14, with the base portion 18*a* positioned adjacent to the connection member 14*a*. As such, the pressure differential device 18, can be shifted away from the connection member 14*a*, to thereby create a pressure differential between the extraction inlet 12*d* and the through-opening 14*c* causing the liquid (and any air within the extraction member 12) to flow through the extraction section 12*a*, through a portion of the transference section 12*b*, through/past the first valve 16*a*, and into the storage vessel 14. Once liquid has begun to flow into the storage vessel 14, the base portion 18*a* of the pressure differential device 18 can be shifted back toward the connection member 14*a*, to expel all of the liquid (and any air) that was received in storage vessel 14. In particular, the liquid will flow out of the storage vessel 14, through/past the second valve 16*b*, through a remaining portion of the transference section 12*b*, through the dispenser section 12*c*, out the liquid dispensing outlet 12*f*, and into the receptacle 13. It should be understood that because the valves 16*a*, 16*b* are configured to only allow liquid to flow in a single direction (i.e., from the container 11 to the storage vessel 14 and/or from the storage vessel 14 to the receptacle 13), the liquid that is forced from the storage vessel 14 and into the receptacle 13 will not be allowed to flow in the opposite direction past the first valve 16*a* in the direction of the container 11.

Furthermore, it is understood that after the liquid has been drawn into and then ejected from the storage vessel 14, portions of the extraction member 12, e.g., the portion extending from the extraction inlet 12*d* to the liquid extraction outlet 12*e*, will remain filled with liquid. In more detail, the valves 16*a*, 16*b* are configured to allow liquid to flow only in a single first direction, i.e., from the container 11 to the storage vessel 14 and/or from the storage vessel 14 to the receptacle 13 as described in the previous paragraph. As such, the valves 16*a*, 16*b* may be configured to restrict liquid from flowing in an opposite, second direction i.e., away from the liquid extraction outlet 12*e* toward the container 11 and/or away from the dispenser section 12*c* toward the extraction outlet 12*e*. The valves 16*a*, 16*b* accomplish such by blocking fluid flow in such opposite direction and/or by maintaining a pressure differential across the valves 16*a* and/or 16*b* that may attempt to inhibit liquid from flowing in the opposite second direction. As such, while the liquid that was drawn into the storage vessel 14 can be forced out through the second valve 16*b*, the remaining liquid that was drawn up through the extraction member 12 from the container 11 will remain in place within the extraction member 12 (i.e., between the container 11 and the storage vessel 14) due to the liquid-blocking and/or pressure-maintaining effects of the valves 16*a*, 16*b*. Such a configuration (i.e., with liquid being maintained within the extraction member 12 from the extraction inlet 12*d* to the liquid extraction outlet 12*e*) is hereinafter referred to as a "primed configuration." It is understood that in the embodiments in which the valves 16*a*, 16*b* are one-way check valves received entirely within the extraction member 12, the vales 16*a*, 16*b* are configured to retain liquid within the extraction member without a user having to actuate and/or physically operate the valves 16*a*, 16*b*. In such a primed configuration, the storage vessel 14 can be re-filled with the liquid from the extraction member 12 and from the container 11 by shifting the base portion 18*a* of the pressure differential device 18 away from the connection member 14*a*. This time, however, the storage vessel 14 will be filled with liquid that has not been exposed to the external environment (e.g., air).

With the storage vessel 14 filled with the liquid, the liquid extraction apparatus 10 is operable to dispense liquid from the storage vessel 14 into the receptacle 13, simply by depressing the base portion 18*a* of the pressure differential device 18 toward the connection member 14*a*, to expel liquid stored within the storage vessel 14 and into the receptacle 13. In particular, the liquid will flow out the storage vessel 14, through/past the second valve 16*b*, through a remaining portion of the transference section 12*b*, through the dispenser section 12*c*, out the liquid dispensing outlet 12*f*, and into the receptacle 13.

In alternative embodiments, once a storage vessel 14 has been filled with liquid, the storage vessel 14 can alternatively dispense the liquid by removing the storage vessel 14 from the extraction member 12. In such embodiments, a seal device may be placed into or onto connection member 14*a* to block air from contacting the liquid and/or to block the liquid from exiting the storage vessel 14. Any type of common seal device can be used, such as, for example, a rubber or silicone stopper, a plug, a threaded cap, a selectively-actuated valve, or the like. Similarly, a seal device may be placed into or onto connection member 12*g* to block air from contacting the liquid and/or to block the liquid from exiting the extraction member 12. Any type of common seal device can be used, such as, for example, a rubber or silicone stopper, a plug, a threaded cap, a selectively-actuated valve, or the like. To dispense the liquid stored in the removed storage vessel 14, the pressure differential device 18 can be moved toward the connection member 14*a* to force some or all of the liquid out through the through-opening 14*c*. In some alternative embodiments, the pressure differential device 18 can be removed from the storage vessel 14 and the liquid can be poured from the storage vessel 14. Furthermore, once removed from the extraction member 12, the storage vessel 14 may be stored for future dispensing of the liquid therein. Beneficially, because the fluid contained within the storage vessel 14 is sealed therein, and because such fluid has not been in contact with the ambient environment, the fluid can be stored within the storage vessel 14 for an extended period (e.g., weeks, months, years, etc.)

In even further alternative embodiments, with the liquid extraction apparatus 10 in the primed configuration, the storage vessel 14 can be removed from the extraction member 12 by disconnecting the connection members 12*g* and 14*a*, and a different storage vessel 14 can be connected to the extraction member 12 to be filled with liquid. In such embodiments, a seal device may be placed into/onto or incorporated within connection member 12*g* to block air from contacting the liquid and/or to block the liquid from exiting the extraction member 12. Any type of common seal device can be used, such as, for example, a rubber or silicone stopper, a plug, a threaded cap, a selectively-actuated valve, or the like. As such, a plurality of different storage vessels 14 can be attached to the extraction member 12 and filled with liquid from the container 11. Beneficially, however, each of the different storage vessels 14 will be filled with liquid that has not been exposed to the external environment (e.g., air).

Figure 2:
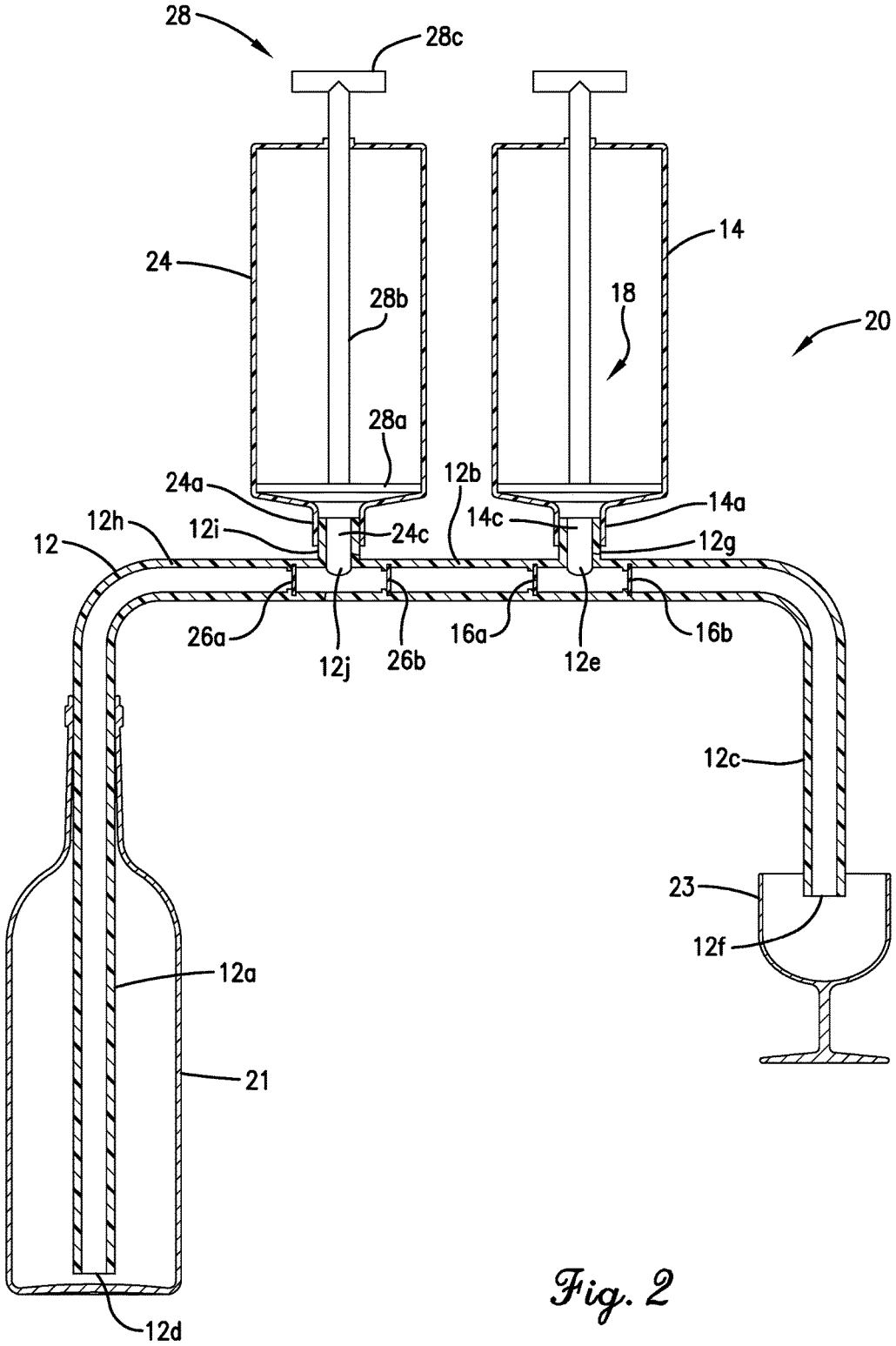
FIG. 2 is an elevational cross-sectional view of a liquid extraction apparatus in accordance with one embodiment of the present invention, particularly illustrating a segmented liquid extraction member and first and second storage vessels located above the container.

FIG. 2 depicts another embodiment of a liquid extraction apparatus 20 in accordance with the present invention. In certain embodiments, the liquid extraction apparatus 20 of FIG. 2 may be similar to, or the same as, the liquid extraction apparatus 10 of FIG. 1, except that the liquid extraction apparatus 20 includes a second storage vessel 24 that is configured for connection to the extraction member 12. Although FIG. 2 only illustrates two storage vessels 14, 24, it should be understood that any number of storage vessels may be included with such liquid extraction apparatus 20. As illustrated in FIG. 2, the liquid extraction apparatus 20 may include a second pressure differential device 28 positioned within the second storage vessel 24 and set apart first and second valves 26*a*, 26*b* positioned between the first valve 16*a* and the extraction inlet 12*d*. The pressure differential device 28 and the first and second valves 26*a*, 26*b* may have the same characteristics and parameters as the pressure differential device 18 and the valves 16*a*, 16*b*, respectively, discussed above with reference to the liquid extraction apparatus 10 of FIG. 1.

In part, the liquid extraction apparatus 20 functions entirely the same as the liquid extraction apparatus 10, as was previously described. For example, the liquid extraction apparatus 20 can initially withdraw a portion of liquid from a container 21 and house such portion of liquid in the storage vessel 14. Thereafter, the storage vessel 14 can eject the portion of the liquid from the storage vessel 14 and into a receptacle 23. After performing such steps, the liquid extraction apparatus 70 will be in the primed configuration, i.e., with liquid being maintained (by way of the valves 16*a*, 16*b* and/or 26*a*, 26*b*) within the portion of the extraction member 12 that extends between the extraction inlet 12*d* and the through-opening 14*c* of the storage vessel 14. Thus, in the primed configuration, both the storage vessel 14 and the second storage vessel 24 can be used to withdraw liquid from the extraction member 12, with such liquid not having been exposed to the external environment (e.g., air). In some embodiments, however, the liquid extraction apparatus 20 may function as described above without the inner valves, i.e., first and second valves 16*a*, 26*b*.

In more detail, the second storage vessel 24 may, in some embodiments, have the same parameters and characteristics as the storage vessel 14 discussed above with reference to FIG. 1. As such, the second storage vessel 24 is coupled in fluid flow communication with extraction member 12. The second storage vessel 24 may include a connection member 24*a* configured to connect to a second connection member 12*i* of the extraction member 12. The second connection member 12*i* presents a second liquid extraction outlet 12*j* in liquid communication with the extraction member 12. The second storage vessel 24 can be connected to the extraction member 12, via the second connection member 12*i*, at a position between the container 21 and the storage vessel 14. Nevertheless, in some embodiments, it may be preferable to attach the second storage vessel 24 to the extraction member 12 at other positions on the transference section 12*b*. In some embodiments, it may preferred for the second storage vessel 24 to be connected to the extraction member 12 in a manner such that the second storage vessel 24 can be positioned vertically (e.g., upward or downward) and can remain connected to the extraction member 12 when the extraction section 12*a* of the extraction member 12 is inserted into the container 21. As illustrated in FIG. 2, the second storage vessel 24 may be positioned in a vertically-upward orientation, such that the second storage vessel 24 extends in a generally opposite direction from the extraction section 12*a*. Alternatively, the second storage vessel 24 may be positioned in a vertically-downward orientation (See, e.g., FIGS. 4-5), such that the second storage vessel 24 extends in generally the same direction as the extraction section 12*a*. In still other embodiments, the second storage vessel 24 may extend at other angles from the extraction member, such that the second storage vessel 24 may be positioned between the upward and downward directions. As shown in the embodiment depicted in FIG. 2, the second connection member 12*i* may extend from the sidewall 12*h* of the transference section 12*b* of the extraction member 12. The second connection member 12*i* may extend in the direction in which the second storage vessel 24 is intended to be positioned, such as upward, downward, or any direction therebetween. In one or more embodiments, the second connection member 12*i* does not extend outwardly from the extraction member 12, but may be formed as part of the sidewall 12*h*.

The connection members 12*i* and 24*a* can include any type of connection device or mechanism as long as there is a through-opening 24*c* for a liquid to flow from the extraction member 12 into the second storage vessel 24. For example, in certain embodiments, the connection members 12*i* and 24*a* can be connected by complimentary threaded portions. In other embodiments, the connection members 12*i* and 24*a* can be connected by a friction-fit connection, a snap-fit connection, or the like. In certain embodiments, the liquid extraction apparatus 20 is configured to maintain liquid within the extraction member 12 via the first and second valves 26*a*, 26*b*, which are positioned on either side of the connection member 12*i*. As such, liquid extraction apparatus 20 can perform entirely the same as liquid extraction apparatus 10 if the storage vessel 14 is removed from the extraction member 12.

Given the liquid extraction apparatus 20 described above, once the liquid extraction apparatus 20 is in the primed configuration, the second storage vessel 24 can be independently filled with the liquid from the extraction member 12 and the container 21 by shifting the base portion 28*a* of the pressure differential device 28 away from the connection member 24*a*. As such, the second storage vessel 24 can be filled with liquid without having to manipulate and/or remove the storage vessel 14. Furthermore, the second storage vessel 24 will be filled with liquid that has not been exposed to the external environment (e.g., air). In the primed configuration, and with the second storage vessel 24 filled with the liquid, the liquid extraction apparatus 20 is operable to dispense liquid from the second storage vessel 24 into the receptacle 23, simply by depressing the base portion 28*a* of the pressure differential device 28 toward the connection member 24*a*, to expel liquid stored within the storage vessel 24 and into the receptacle 13. In particular, the liquid will flow out the storage vessel 24, through/past the second valve 26*b*, through a portion of the transference section 12*b*, past valves 16*a*, 16*b*, through a remaining portion of the transference section 12*b*, through the dispenser section 12*c*, out the liquid dispensing outlet 12*f*, and into the receptacle 23. If the storage vessel 14 is removed, such liquid transference can take place if a seal device is placed into or onto connection member 12*g* of the extraction member 12 to block air from contacting the liquid and/or to block the liquid from exiting the extraction member 12 via the liquid extraction outlet 12*e*.

In alternative embodiments, after filling the second storage vessel 24, the second storage vessel 24 can be removed and one or more additional storage vessels 24 can be individually connected to the connection member 12*i* of the extraction member 12 so as to also be filled with liquid. Between the transitioning of storage vessels 24, a seal device may be placed into or onto connecting member 12*i* to block air from contacting the liquid and/or to block the liquid from exiting the extraction member 12. Any type of common seal device can be used, such as, for example, a rubber or silicone stopper, a plug, a selectively-actuated valve, or the like.

Regardless, once a second storage vessel 24 has been filled with liquid, the second storage vessel 24 can, alternatively dispense the liquid by removing the second storage vessel 24 from the extraction member 12, as previously described. In such embodiments, a seal device may be placed into or onto connection member 24*a* to block air from contacting the liquid and/or to block the liquid from exiting the second storage vessel 24. Any type of common seal device can be used, such as, for example, a rubber or silicone stopper, a plug, a selectively-actuated valve, or the like. Similarly, a seal device may be placed into or onto connecting member 22*i* to block air from contacting the liquid and/or to block the liquid from exiting the extraction member 12. Any type of common seal device can be used, such as, for example, a rubber or silicone stopper, a plug, a selectively-actuated valve, or the like. To dispense the liquid stored in the second storage vessel 24, the base portion 28*a* of the pressure differential device 28 can be moved toward the connection member 24*a* to force some or all of the liquid out through the through-opening 24*c* of the second storage vessel 24.

Figure 3:
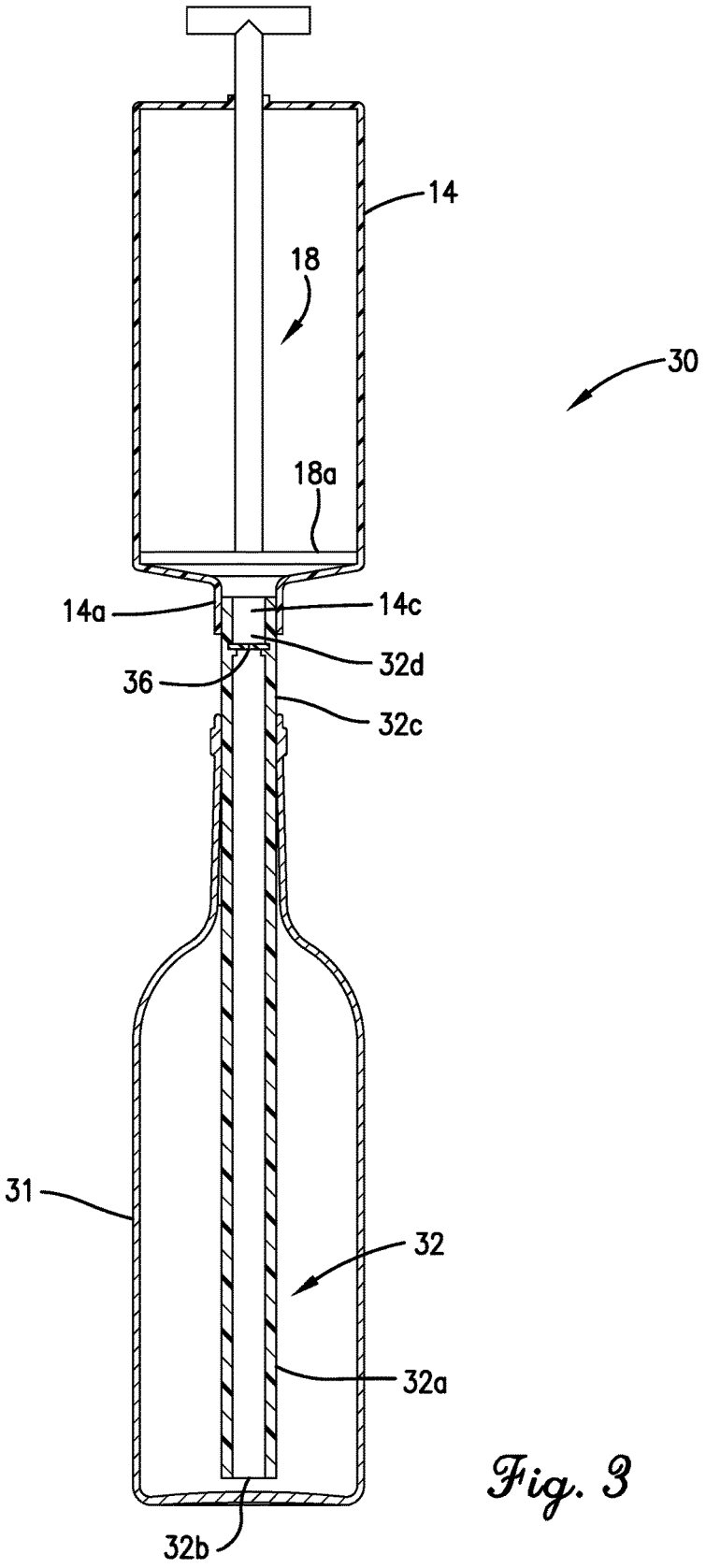
FIG. 3 is an elevational cross-sectional view of a liquid extraction apparatus in accordance with one embodiment of the present invention, particularly illustrating a liquid extraction member and a single storage vessel located above the container.

FIG. 3 depicts another embodiment of a liquid extraction apparatus 30 in accordance with the present invention. The liquid extraction apparatus 30 can be used with any liquids or any containers, such as, for example, the liquids and containers related to the liquid extraction apparatus 10 of FIG. 1. In certain embodiments, the liquid extraction apparatus 30 will be used with a container 31, which is a wine bottle and which contains wine as the liquid. The liquid extraction apparatus 30 of FIG. 3 includes a storage vessel 14, a liquid extraction member 32, a valve 36, and a pressure differential device 18. In some embodiments, one or more components of the liquid extraction apparatus 30 may be similar to certain components the liquid extraction apparatuses 10 of FIG. 1. For example, the storage vessel 14 of the liquid extraction apparatus 30 may have the same characteristics and parameters as the storage vessel 14 of the liquid extraction apparatus 10 of FIG. 1. Additionally, the valve 36 and the pressure differential device 18 of the liquid extraction apparatus 30 may have the same characteristics and parameters as one of the valves 16*a*, 16*b* and the pressure differential device 18, respectively, as discussed above with reference to liquid extraction apparatus 10 of FIG. 1. For instance, the valve 36 may be a one-way check valve, and the pressure differential device 18 may be a shiftable plunger. Contrastingly, instead of the segmented liquid extraction member 12 of liquid extraction apparatus 10, the liquid extraction apparatus 30 may include the singular liquid extraction member 32, which, as illustrated in FIG. 3, may but need not have a generally linear shape.

In more detail, the liquid extraction member 32 includes a first end 32*a* that defines a liquid extraction inlet 32*b* and a second end 32*c* that defines a liquid extraction outlet 32*d*. The liquid extraction member 32 may not include a dispensing outlet. The second end 32*c* of the extraction member 32 may be removably coupled to the storage vessel 14. For example, in one or more embodiments, the second end 32*c* of the extraction member 32 can be coupled to a connection member 14*a* of the storage vessel 14 by complimentary threaded portions. The connection member 14*a* may define through-opening 14*c*, through which liquid can flow from the extraction member 32 to within the storage vessel 14. It is understood, however, the extraction member 32 can be removably coupled to the storage vessel 14 in a variety of other ways, and a particular method can be chosen by one skilled in the art. For example, in certain embodiments, the extraction member's 32 second end 32*c* and the connection member 14*a* can be connected by friction-fit connection, snap-fit connection, or the like.

The valve 36 may be positioned within the extraction member 32 anywhere along the extraction member's 32 length. However, as illustrated in FIG. 3, it may be preferred for the valve 36 to be positioned adjacent to the second end 32*c* of the extraction member 32, at a position just below the through-opening 14*c* and/or where the extraction member 32 connects with the storage vessel 14. Furthermore, in some embodiments, the valve 36 is configured to only allow liquid to flow in a single direction, with such direction being from the container 31 to the storage vessel 14.

In certain embodiments, to extract a liquid from the container 31, the extraction member 32 can be inserted into the container 31 so that the extraction inlet 32*b* is positioned below the surface of the liquid in the container 31. As such, base portion 18*a* of the pressure differential device 18, which is located inside the storage vessel 14, can be shifted away from the connection member 14*a*, to create a pressure differential between the extraction inlet 32*b* and the through-opening 14*c* causing the liquid (and any air within the extraction member 32) to flow through the extraction member 32, through/past the valve 36, and into the storage vessel 14. Once liquid has begun to flow into the storage vessel 14, the storage vessel 14 can be removed from the extraction member 32 to dispose of the liquid and any air that was extracted into the storage vessel 14.

Because the valve 36 is configured to only allow liquid to flow in a single direction (i.e., from the container 31 to the storage vessel 14), once liquid has been drawn into the storage vessel 14, even if the storage vessel 14 is subsequently removed, liquid within the extraction member 32 will be prevented from falling back into the container 31 due to the liquid-flow restricting and/or pressure-maintaining effects of the valve 36. Such a configuration, i.e., with liquid being maintained within the extraction member 32 between the second end 32*c* and the extraction inlet 32*b* is referred to as a "primed configuration." In such a primed configuration, the storage vessel 14 (now emptied), can be reattached to the extraction member 32, such that the storage vessel 14 can be refilled by extracting the liquid from the extraction member 32 and from the container 31. This time, however, the extracted liquid will not have been exposed to the external environment (e.g., air). In additional embodiments, one or more additional storage vessels 14 can, alternatively, be attached to the extraction member 32 to extract liquid that has not been exposed to air.

Once the storage vessel 14 has been filled with liquid, the storage vessel 14 can, dispense the liquid by removing the storage vessel 14 from the extraction member 32. In such embodiments, a seal device may be placed into or onto connection member 14*a* of the storage vessel 14 to block air from contacting the liquid and/or to block the liquid from exiting the storage vessel 14. Any type of common seal device can be used, such as, for example, a rubber or silicone stopper, a plug, a threaded cap, a selectively-actuated valve, or the like. Similarly, a seal device may be placed into or onto the liquid extraction outlet 32*d* of the extraction member 32 to block air from contacting the liquid and/or to block the liquid from exiting the extraction member 32. Any type of common seal device can be used, such as, for example, a rubber or silicone stopper, a plug, a selectively-actuated valve, or the like. To dispense the liquid stored in the storage vessel 14, the pressure differential device 18 can be moved toward the connection member 14*a* to force some or all of the liquid out through the through-opening 14*c* of the storage vessel 14.

Figure 4:
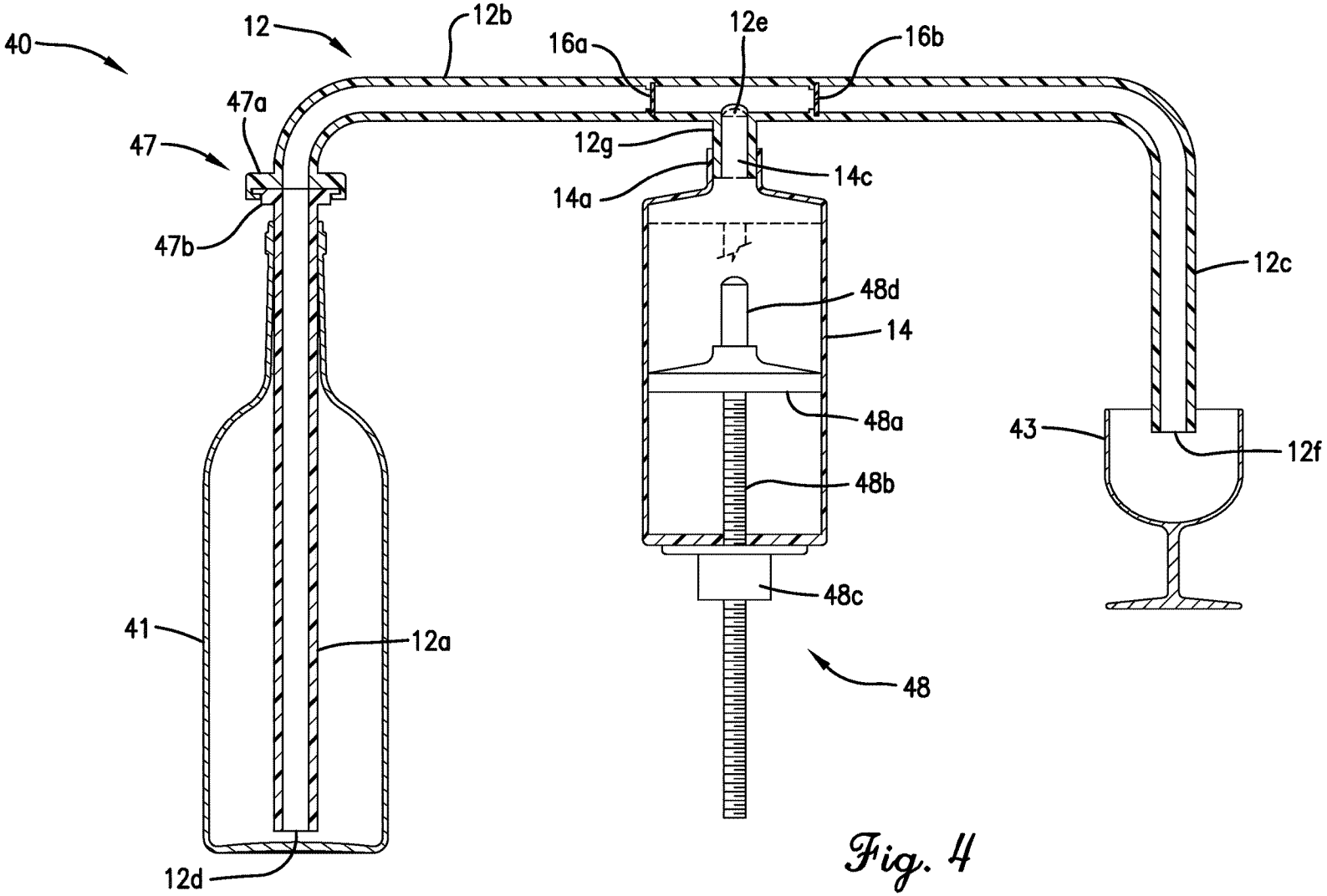
FIG. 4 is an elevational cross-sectional view of a liquid extraction apparatus in accordance with one embodiment of the present invention, particularly illustrating a segmented liquid extraction member partly received inside a container, a pressure differential device comprising a motor associated with the storage vessel and a shiftable barrier received within the storage vessel, and first and second valves received inside the extraction member.

FIG. 4 depicts another embodiment of a liquid extraction apparatus 40 in accordance with the present invention. The liquid extraction apparatus 40 can be used with any liquids or any containers, such as, for example, the liquids and containers related to the liquid extraction apparatus 10 of FIG. 1. In certain embodiments, the liquid extraction apparatus 40 will be used with a container 41, which is a wine bottle and which contains wine as the liquid. The liquid extraction apparatus 40 of FIG. 4 may include certain of the same components and characteristics as the liquid extraction apparatus 10 of FIG. 1. For instance, as shown in FIG. 4, the liquid extraction apparatus 40 may include liquid extraction member 12, storage vessel 14, and first and second valves 16*a*, 16*b*, with each of such components being similar (or the same) as the corresponding components from the liquid extraction apparatus 10. Contrastingly, however, the liquid extraction apparatus may 40 may include a pressure differential device 48 that is different from the pressure differential device 18 included in liquid extraction apparatus 10 illustrated in FIG. 1.

In more detail, and with reference to FIG. 4, the pressure differential device 48 comprises a base portion 48*a*, a shaft 48*b* extending from the base portion 48*a*, and an actuator 48*c* engaged with at least a portion of the shaft 48*b*. As with the base portion 18*a* previously-described in relation to liquid extraction apparatus 10 of FIG. 1, the base portion 48*a* of liquid extraction apparatus 40 can also be comprised of any flexible or rigid material (or any combination thereof) that is capable of creating a pressure differential so as to draw liquid into the storage vessel 14 from the extraction member 12 and the container 41. For example, the base portion 48*a* may include any material that is capable of blocking air and/or liquid from passing through or around the base portion 48*a*, such as, for example, silicone, rubber, and/or a rubber-like material. As such, the base portion 48*a* may be configured to act as a shiftable barrier that is capable of preventing air and/or liquid from entering into the storage vessel 14 and/or from passing from one side of the base portion 48*a* to the other.

As illustrated in FIG. 4, the pressure differential device 48 may additionally comprise a plug element 48*d* that extends from the base portion 48*a* towards the extraction member 12 when the storage vessel 14 is connected with the extraction member 12. The plug element 48*d* may be formed from the same material that the base portion 48*a* is formed, and in some embodiments, the plug element 48*d* may be integrally formed as part of the base portion 48*a*. The plug element 48*d* may be sized to be received within at least a portion of the through-opening 14*c* presented by the connection member 14*a*, as well as at least a portion of the liquid extraction outlet 12*e* of the extraction member 12. As such, with the pressure differential device 48 positioned within the storage vessel 14, and with the base portion 48*a* positioned adjacent to the connection member 14*a*, the plug element will be received within at least a portion of the through-opening 14*c* presented by the connection member 14*a*. The ability for the plug element 48*d* to be received within the through-opening 14*c* and, in some embodiments, portions of the liquid extraction outlet 12*e*, provides for the storage vessel 14 to be completely purged of liquid and/or air. For example, if the base portion 48*a* is shifted from a position away from the connection member 14*a* to a position adjacent to the connection member 14*a*, the base portion 48*a* will purge any liquid and/or air from the internal storage chamber 14*e* (See FIG. 1) of the storage vessel 14. Furthermore, the ability of the plug element 48*d* to be received within the through-opening 14*c* and the liquid extraction outlet 12*e* allows those areas to be purged of liquid and/or air so as to enhance the ability of the storage vessel 14 as a whole to be purged of any liquid and/or air that may be received therein.

The position of the base portion 48*a* can be controlled by the actuator 48*c*, which is configured to actuate the shaft 48*b* that in turn actuates the base portion 48*a*. In the embodiments illustrated in FIG. 4, the actuator 48*c* comprises a rotary motor, such as a hollow-shaft motor, and the shaft 48*b* comprises a threaded shaft. In other embodiments, the actuator 48*c* may comprise other types of actuators, such as a linear actuator, and the shaft 48*b* may comprise a non-threaded shaft. In some embodiments, such as shown in FIG. 4, the actuator 48*c* may be secured to the storage vessel 14; though, in other embodiments, the actuator 48*c* may not be directly secured to the storage vessel 14. Returning to FIG. 4, the shaft 48*b* may be configured to extend through the actuator 48*c*, such that the actuator will engage with the threads on the shaft 48*b* so as to actuate the shaft 48*b* with respect to the storage vessel 14. For instance, with the actuator 48*c* rotating in a first direction, the shaft 48*b* will be caused to actuate away from the connection member 14*a* of the storage vessel 14, such that the base portion 48*a* similarly actuates away from the connection member 14*a*. Contrastingly, with the actuator 48*c* rotating in an opposite, second direction, the shaft 48*b* will be caused to actuate towards the connection member 14*a* of the storage vessel 14, such that the base portion 48*a* similarly actuates towards the connection member 14*a*.

In operation, the extraction section 12*a* of the extraction member 12 can be inserted into the container 41 so that the extraction inlet 12*d* is positioned below the surface of the liquid in the container 41. Additionally, portions of the pressure differential device 48 will be positioned within the storage vessel 14, with the base portion 48*a* positioned adjacent to the connection member 14*a* (as shown in broken line in FIG. 4). As such, the actuator 48*c* can actuate the shaft 48*b* in a first direction so that the base portion 48*a* is be shifted away from the connection member 14*a*, to thereby create a pressure differential between the extraction inlet 12*d* and the through-opening 14*c*, causing liquid (and any air within the extraction member 12) to flow through the extraction section 12*a*, through a portion of the transference section 12*b*, through/past the first valve 16*a*, and into the storage vessel 14. Once liquid has begun to flow into the storage vessel 14, the actuator 48*c* can actuate the shaft 48*b* in the an opposite, second direction so that the base portion 48*a* is shifted back toward the connection member 14*a*, so to expel all of the liquid (and any air) that was received in storage vessel 14. In particular, the liquid will flow out the storage vessel 14, through/past the second valve 16*b*, through a remaining portion of the transference section 12*b*, through the dispenser section 12*c*, out the liquid dispensing outlet 12*f*, and into the receptacle 43. It should be understood that because the valves 16*a*, 16*b* are configured to only allow liquid to flow in a single direction (i.e., from the container 41 to the storage vessel 14 and/or from the storage vessel 14 to the receptacle 43), the liquid that is forced from the storage vessel 14 and into the receptacle 43 will not be allowed to flow past the first valve 16*a* in the direction of the container 41. As such, with the liquid extraction apparatus 40 in the primed configuration, the storage vessel 14 can be re-filled with the liquid from the extraction member 12 and from the container 41 by shifting the base portion 48*a* of the pressure differential device 18 away from the connection member 14*a*. This time, however, the storage vessel 14 will be filled with liquid that has not been exposed to the external environment (e.g., air).

With the storage vessel 14 filled with the liquid, the liquid extraction apparatus 40 is operable to dispense liquid from the storage vessel 14 into the receptacle 43, simply by causing the base portion 48*a* of the pressure differential device 48 to be shifted toward the connection member 14*a*, to expel part or all of any liquid stored within the storage vessel 14 into the receptacle 43. In particular, the liquid will flow out the storage vessel 14, through/past the second valve 16*b*, through a remaining portion of the transference section 12*b*, through the dispenser section 12*c*, out the liquid dispensing outlet 12*f*, and into the receptacle 43.

In alternative embodiments, as with the liquid extraction apparatus 10 described above, once the storage vessel 14 of extraction apparatus 40 has been filled with liquid, the storage vessel 14 can alternatively dispense the liquid by removing the storage vessel 14 from the extraction member 12. In such embodiments, a seal device may be placed into or onto connection member 14*a* to block air from contacting the liquid and/or to block the liquid from exiting the storage vessel 14. Any type of common seal device can be used, such as, for example, a rubber or silicone stopper, a plug, a threaded cap, a selectively-actuated valve, or the like. Similarly, a seal device may be placed into or onto connection member 12*g* to block air from contacting the liquid and/or to block the liquid from exiting the extraction member 12. Any type of common seal device can be used, such as, for example, a rubber or silicone stopper, a plug, a selectively-actuated valve, or the like. To dispense the liquid stored in the removed storage vessel 14, the actuator 48*c* can actuate the base portion 48*a* of the pressure differential device 48 to be shifted toward the connection member 14*a* to force some or all of the liquid out through the through-opening 14*c*. In some alternative embodiments, the pressure differential device 48 can be removed from the storage vessel 14 and the liquid can be poured from the storage vessel 14.

In even further alternative embodiments, with the liquid extraction apparatus 40 in the primed configuration, the storage vessel 14 can be removed from the extraction member 12 by disconnecting the connection members 12*g* and 14*a*, and a different storage vessel 14 can be connected to the extraction member 12 to be filled with liquid. In such embodiments, a seal device may be placed into or onto connection member 12*g* to block air from contacting the liquid and/or to block the liquid from exiting the extraction member 12. Any type of common seal device can be used, such as, for example, a rubber or silicone stopper, a plug, a selectively-actuated valve, or the like. As such, a plurality of different storage vessels 14 can be attached to the extraction member 12 and filled with liquid from the container 41. Beneficially, however, each of the different storage vessels 14 will be filled with liquid that has not been exposed to the external environment (e.g., air).

The actuator 48*c* of the pressure differential device 48 may be powered electrically, pneumatically, hydraulically, or the like. Similarly, the actuator 48*c* may be controlled by various control methods, such as a physical control system or an automated control system. For the physical control system, embodiments of the present invention may provide for one or more push-buttons, knobs, dials, touchscreen, or other similar controls from which a user can actuate the pressure differential device 48. For example, embodiments may provide a first push-button that causes the base portion 48*a* to be actuated away from the connection member 14*a* of the storage vessel 14 and a second push-button that causes the base portion to be actuate towards the connection member 14*a*. The push-buttons may be in communication with the actuator 48*c* via a wired connection (e.g., via physical wires/cables) or wirelessly (e.g., radio-frequency, Wi-Fi, Bluetooth, etc.).

For the automated control system, the actuator 48*c* may be in communication with one or more sensors and/or inputs that provide automated instructions for controlling the position of the base portion 48*a*. Certain embodiments may provide for the automated control system to include a programmable logic controller (PLC), a field-programmable gate array (FPGA), a microprocessor, processor(s) and associated memory elements, or the like for obtaining information from the sensors and/or inputs and providing instructions to the actuator 48*c* based on the inputs. In some embodiments, the sensors and/or inputs may comprise a position sensor, a pressure sensor, or a timer. The position sensor may comprise an optical sensor, a mechanical switch, a magnetic sensor, or the like and may be operable to sense a position of any of the one or more components of the pressure differential device 48. For instance, the position sensor may be capable of sensing when the base portion 48*a* is positioned adjacent to the connection member 14*a* and/or when the base portion 48*a* is positioned at a maximum distance from the connection member 14*a*. The position sensor may also determine when the base portion 48*a* is positioned anywhere in between such extreme positions. Alternatively, the pressure sensor may be capable of sensing a pressure within an interior of the storage vessel 14. As such, the pressure sensor may be capable of sensing when the pressure within the storage vessel 14 is at a minimum such that the base portion 48*a* is positioned adjacent to the connection member 14*a* (e.g., no liquid in the storage vessel 14). Similarly, the pressure sensor may be capable of sensing when the pressure within the storage vessel is at a maximum, such as when the base portion 48*a* is positioned at a maximum distance from the connection member 14*a* (i.e., the storage vessel filled with liquid). The pressure sensor may also determine pressures between the minimum and maximum, such as when the base portion 48*a* is positioned anywhere in between. Furthermore, embodiments of the present invention may include a safety shut-off valve connected to the pressure sensor, such that if an over and/or an under-pressure are detected, the actuator 48*c* can be stopped so as to prevent failure of or damage to the liquid extraction apparatus 40. In still further alternatives, the timer may be used to determine when the base portion 48*a* has travelled from a positioned adjacent to the connection member 14*a* to the maximum distance from the connection member 14*a*, and vice-a-versa. The timer may take into consideration an actuation speed of the actuator 48*c*. Given the automated control system components described above, the liquid extraction apparatus 40 can be used to fill the storage vessel 14, as previously described, in an automated fashion with liquid that has not been in contact with external contaminates (e.g., air). Similarly, the automated control system can be used to dispense liquid to the receptacle 43, as previously described, in an automated fashion.

As with the embodiments previously described, it is understood that the liquid extraction apparatus 40 can include any number of storage vessels 14 secured to the extraction member 12. For instance, as was illustrated in FIG. 2 of liquid extraction apparatus 20, the liquid extraction apparatus 40 may include two or more storage vessels 14. Furthermore, the storage vessels 14 of the liquid extraction apparatus 40 may be secured to the extraction member 12 in various orientations. For instance, as illustrated in FIG. 4, the storage vessels may extend vertically downward from the extraction member 12. Alternatively, as shown in FIG. 1-3, the storage vessels 14 may extend vertically upward. In still other embodiments the storage vessels may extend from the extraction member 12 at other orientations, such as horizontally.

As illustrated in FIG. 4, certain embodiments of the present invention provide for various portions of the extraction member 12 to be connected and separated via one or more connection members 47. The connection members 47 may comprise two interconnectable connection pieces 47*a*, 47*b* that are each configured to be permanently secured to and/or formed integral with a portion of the extraction member 12. The connection pieces 47*a*, 47*b* may be releasably connected to each other via various means of attachment, such as a snap-fit connection, a threaded connection, or the like. As such, various portions of the extraction member 12 can be separated and reconnected via the connection pieces 47*a*, 47*b*. For example, as shown in FIG. 4, a portion of the extraction section 12*a* of the extraction member 12 may be separated from the remaining portions of the extraction member 12 via the connection pieces 47*a*, 47*b*. Such disconnection may be beneficial, for instance, when inserting or removing the extraction section 12*a* from within the container 41. Additionally, however, the portion of the extraction member 12*a* can be reconnected to the remaining portions of the extraction member 12 when the liquid extraction apparatus 40 is being used to extract liquid from the container 41. Although FIG. 4 only shows the single connection member 47, it should be understood that the liquid extraction apparatus can include a plurality of connection members 47 for separating and connection various portions of the extraction member 12.

Figure 5:
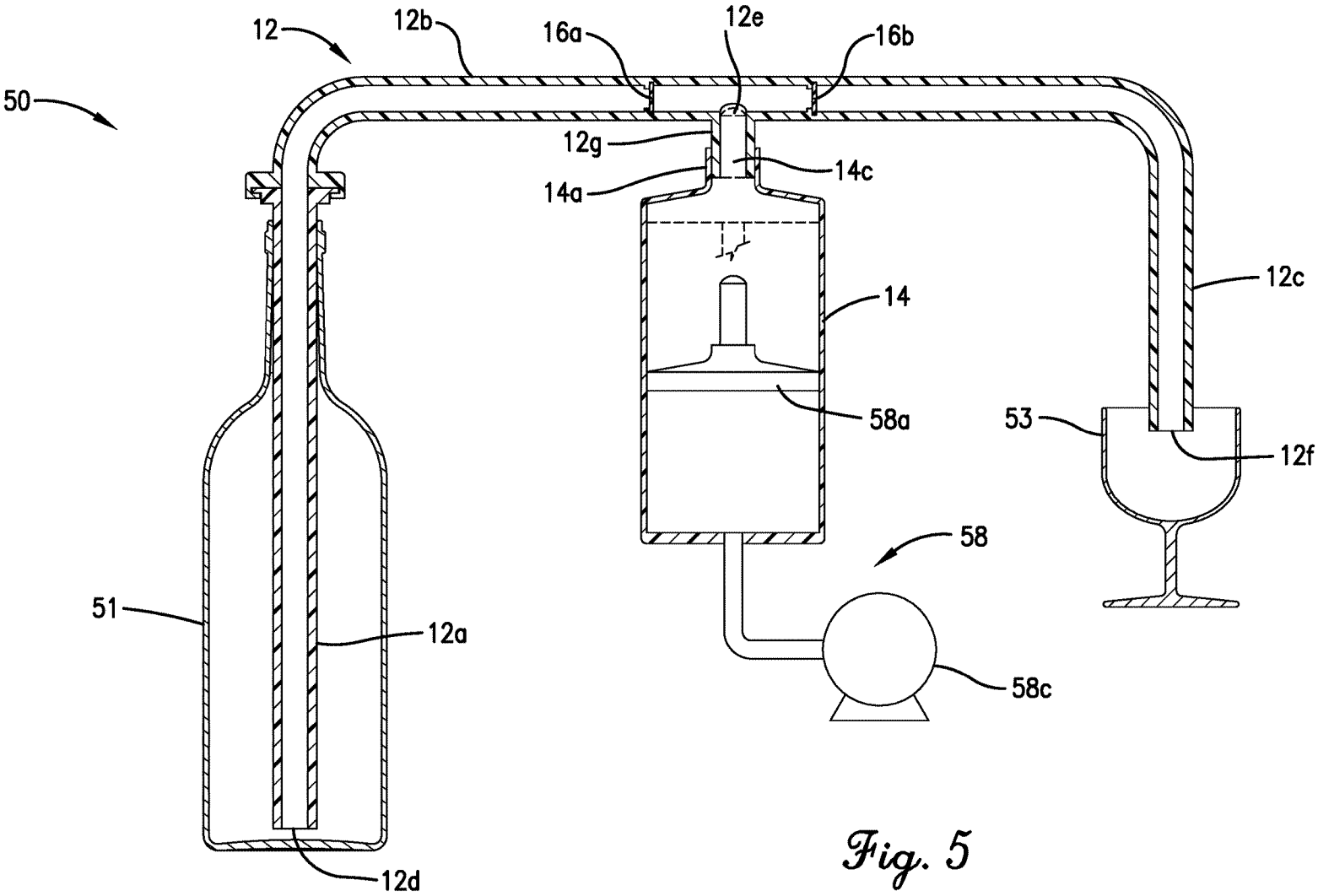
FIG. 5 is an elevational cross-sectional view of a liquid extraction apparatus in accordance with one embodiment of the present invention, particularly illustrating a segmented liquid extraction member partly received inside a container, a pressure differential device comprising a pump fluidly connected with a storage vessel and a shiftable barrier received within the storage vessel, and first and second valves received inside the extraction member.

FIG. 5 depicts another embodiment of a liquid extraction apparatus 50 in accordance with the present invention. The liquid extraction apparatus 50 can be used with any liquids or any containers, such as, for example, the liquids and containers related to the liquid extraction apparatuses previously discussed. In certain embodiments, the liquid extraction apparatus 50 will be used with a container 51, which is a wine bottle and which contains wine as the liquid. The liquid extraction apparatus 50 of FIG. 5 may include certain of the same components and characteristics as the liquid extraction apparatus 40 of FIG. 4. For instance, as shown in FIG. 5, the liquid extraction apparatus 50 may include liquid extraction member 12, storage vessel 14, and first and second valves 16*a*, 16*b*, with each of such components being similar (or the same) as the corresponding components from the liquid extraction apparatus 40. Contrastingly, however, the liquid extraction apparatus may 50 may include a pressure differential device 58 that is different from the pressure differential device 48 included in liquid extraction apparatus 40 illustrated in FIG. 4.

In more detail, and with reference to FIG. 5, the pressure differential device 58 comprises a base portion 58*a* and a pump 58*c*. As with the base portion 48*a* previously-described in relation to liquid extraction apparatus 40 of FIG. 4, the base portion 58*a* of liquid extraction apparatus 50 can also be comprised of any flexible or rigid material (or any combination thereof) that is capable of creating a pressure differential so as to draw liquid into the storage vessel 14 from the extraction member 12 and the container 51. For example, the base portion 58*a* may include any material that is capable of blocking air and/or liquid from passing through or around the base portion 58*a*, such as, for example, silicone, rubber, and/or a rubber-like material. As such, the base portion 58*a* may be configured to act as a shiftable barrier that is capable of preventing air and/or liquid from entering into the storage vessel 14 and/or from passing from one side of the base portion 58*a* to the other.

The position of the base portion 58*a* can be controlled by the pump 58*c*, which is configured to actuate the base portion 58*a*. In the embodiments illustrated in FIG. 5, the pump 58*c* may comprise a reversible air pump that is fluidly connected to the storage vessel 14 on a side opposite of the connection member 14*a*. Other embodiments may provide for the pump 58*c* to include other types of pumps, such as a hydraulic pump. Regardless, with the pump 58*c* operating to create an underpressure within the storage vessel 14, i.e., a pressure that is less than a pressure at the liquid extraction outlet 12*e*, the base portion 58*a* will be caused to actuate away from the connection member 14*a* of the storage vessel 14. Contrastingly, with the pump 58*c* operating to create an overpressure within the storage vessel 14, i.e., a pressure higher than the pressure at the liquid extraction outlet 12*e*, the base portion 58*a* will be caused to actuate towards the connection member 14*a*.

In operation, the extraction section 12*a* of the extraction member 12 can be inserted into the container 51 so that the extraction inlet 12*d* is positioned below the surface of the liquid in the container 51. Additionally, the base portion 58*a* of the pressure differential device 58 will be positioned within the storage vessel 14, with the base portion 58*a* positioned adjacent to the connection member 14*a* (as shown in broken line in FIG. 5). As such, the pump 58*c* can create an underpressure in the storage vessel 14 so as to cause the base portion 58*a* to be shifted away from the connection member 14*a*, to thereby create a pressure differential between the extraction inlet 12*d* and the through-opening 14*c*, causing liquid (and any air within the extraction member 12) to flow through the extraction section 12*a*, through a portion of the transference section 12*b*, through/past the first valve 16*a*, and into the storage vessel 14. Once liquid has begun to flow into the storage vessel 14, the pump 58*c* can create an overpressure within the storage vessel 14 so that the base portion 58*a* is shifted back toward the connection member 14*a*, so to expel all of the liquid (and any air) that was received in storage vessel 14. In particular, the liquid will flow out the storage vessel 14, through/past the second valve 16*b*, through a remaining portion of the transference section 12*b*, through the dispenser section 12*c*, out the liquid dispensing outlet 12*f*, and into the receptacle 53. It should be understood that because the valves 16*a*, 16*b* are configured to only allow liquid to flow in a single direction (i.e., from the container 51 to the storage vessel 14 and/or from the storage vessel 14 to the receptacle 53), the liquid that is forced from the storage vessel 14 and into the receptacle 53 will not be allowed to flow past the first valve 16*a* in the direction of the container 51. Furthermore, with the liquid extraction apparatus 50 in the primed configuration, the storage vessel 14 can be re-filled with the liquid from the extraction member 12 and from the container 51 by shifting the base portion 58*a* of the pressure differential device 58 away from the connection member 14*a*. This time, however, the storage vessel 14 will be filled with liquid that has not been exposed to the external environment (e.g., air).

In the primed configuration, and with the storage vessel 14 filled with liquid obtained from the container 51, the liquid extraction apparatus 50 is operable to dispense liquid from the storage vessel 14 into the receptacle 53. Such dispensing may be performed simply by shifting the base portion 58*a* of the pressure differential device 58 towards the connection member 14*a*, via the pump 58*c*, so as to expel any liquid stored within the storage vessel 14. In more detail, the liquid will flow out the storage vessel 14, through/past the second valve 16*b*, through a remaining portion of the transference section 12*b*, through the dispenser section 12*c*, out the liquid dispensing outlet 12*f*, and into the receptacle 53.

In alternative embodiments, as with the liquid extraction apparatus 40 described above, once the storage vessel 14 of extraction apparatus 50 has been filled with liquid, the storage vessel 14 can alternatively dispense the liquid by removing the storage vessel 14 from the extraction member 12. In such embodiments, a seal device may be placed into or onto connection member 14*a* to block air from contacting the liquid and/or to block the liquid from exiting the storage vessel 14. Any type of common seal device can be used, such as, for example, a rubber or silicone stopper, a plug, a threaded cap, a selectively-actuated valve, or the like. Similarly, a seal device may be placed into or onto connection member 12*g* to block air from contacting the liquid and/or to block the liquid from exiting the extraction member 12. Any type of common seal device can be used, such as, for example, a rubber or silicone stopper, a plug, a selectively-actuated valve, or the like. To dispense the liquid stored in the removed storage vessel 14, the pump 58*c* can shift the base portion 58*a* of the pressure differential device 58 toward the connection member 14*a* to force some or all of the liquid out through the through-opening 14*c*. In some alternative embodiments, the base portion 58*a* of the pressure differential device 58 can be removed from the storage vessel 14 and the liquid can be poured from the storage vessel 14.

In even further alternative embodiments, with the liquid extraction apparatus 50 in the primed configuration, the storage vessel 14 can be removed from the extraction member 12 by disconnecting the connection members 12*g* and 14*a*, and a different storage vessel 14 can be connected to the extraction member 12 to be filled with liquid. In such embodiments, a seal device may be placed into or onto connection member 12*g* to block air from contacting the liquid and/or to block the liquid from exiting the extraction member 12. Any type of common seal device can be used, such as, for example, a rubber or silicone stopper, a plug, a selectively-actuated valve, or the like. As such, a plurality of different storage vessels 14 can be attached to the extraction member 12 and filled with liquid from the container 51. Beneficially, however, each of the different storage vessels 14 will be filled with liquid that has not been exposed to the external environment (e.g., air).

Figure 6:
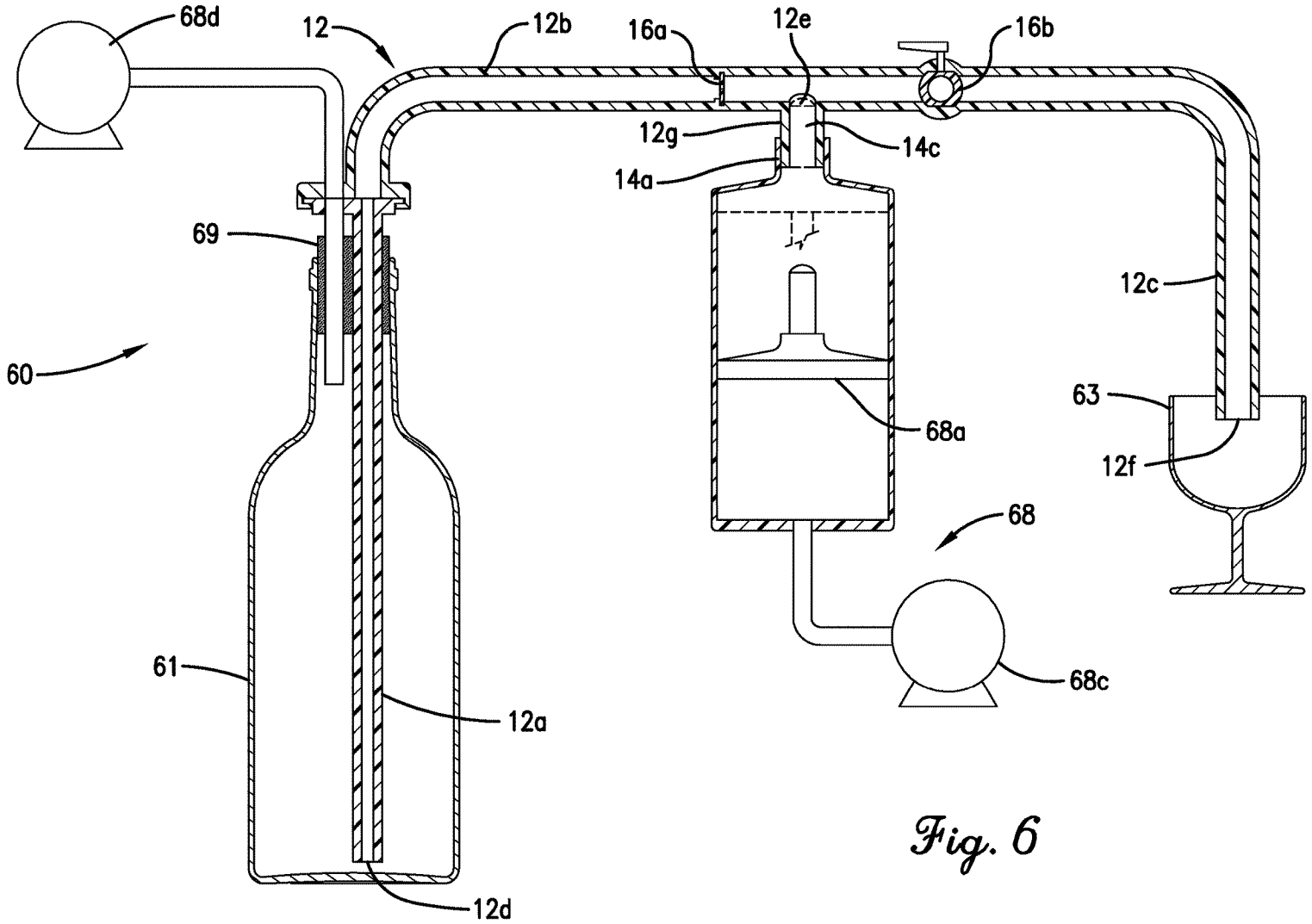
FIG. 6 is an elevational cross-sectional view of a liquid extraction apparatus in accordance with one embodiment of the present invention, particularly illustrating a segmented liquid extraction member partly received inside a container, a pressure differential device comprising a first pump fluidly connected with a storage vessel, a second pump fluidly connected with the container, and a shiftable barrier received within the storage vessel, and further illustrating first and second valves received inside the extraction member.

FIG. 6 depicts another embodiment of a liquid extraction apparatus 60 in accordance with the present invention. The liquid extraction apparatus 60 can be used with any liquids or any containers, such as, for example, the liquids and containers related to the liquid extraction apparatuses previously discussed. In certain embodiments, the liquid extraction apparatus 60 will be used with a container 61, which is a wine bottle and which contains wine as the liquid. The liquid extraction apparatus 60 of FIG. 6 may include certain of the same components and characteristics as the liquid extraction apparatus 50 of FIG. 5. For instance, and with reference to FIG. 6, the liquid extraction apparatus 60 may include liquid extraction member 12, storage vessel 14, and first valve 16*a*, with each of such components being, in some embodiments, similar (or the same) as the corresponding components from the liquid extraction apparatus 60. Contrastingly, however, the liquid extraction apparatus 60 may include a pressure differential device 68 that is different from the pressure differential device 58 included in liquid extraction apparatus 50 illustrated in FIG. 5. Specifically, instead of a single pump 58*c*, the pressure differential device 68 of the liquid extraction apparatus 60 may include a first pump 68*c* configured for providing an overpressure to the storage vessel 14, i.e., a pressure higher than the pressure at the liquid extraction outlet 12*e*, for shifting the base portion 68*a* towards the connection member 14*a* of the storage vessel 14. The pressure differential device 68 may further comprise a second pump 68*d* configured for providing an overpressure to the container 61, i.e., a pressure higher than the pressure at the liquid extraction outlet 12*e*, to force some or all of the liquid from the container 61 and into the storage vessel 14.

The first pump 68*c* may be similar to the pump 58*c* of the liquid extraction apparatus 50, except that the first pump 68*c* may be configured to only provide an overpressure to the storage vessel 14 and may not provide a partial vacuum. As such, the pump 68*c* may be configured as an air pump, a hydraulic pump, or the like. As mentioned above, the second pump 68*d* is configured to provide an overpressure to the container 61. Because of the pump's 68*d* interaction with the liquid within the container 61, it may be preferable for the pump 68*d* to comprise an air pump. To create the overpressure within the container 61, the liquid extraction apparatus 60 may include a container connector 69 configured to allow an overpressure to be provided to the container 61 via the second pump 68*d*, while allowing liquid to exit from the container 61 through the extraction member 12 and into the storage vessel 14. In more detail, as shown in FIG. 6, the container connection 69 may comprise a cylindrical stopper-type device formed from rubber, silicone, or another material capable of forming a fluid seal within the opening of the container 61. The container connection 69 may include a first through-opening through which the extraction section 12*a* of the extraction member 12 extends when the extraction section 12*a* is inserted within the container. The first through-opening is sized so as to form a fluid seal around the extraction section 12*a*. The container connection 69 may additionally include a second through-opening through which a tubular component can extend, with such tubular component fluidly connecting the second pump 68*d* with the interior of the container 61.

In operation, the container connection 69 can be inserted within the opening (i.e., the neck portion) of the container 61. In addition, the extraction section 12*a* of the extraction member 12 can be inserted into the container 61, via the first through-opening of the container connection 69, so that the extraction inlet 12*d* is positioned below the surface of the liquid in the container 61. In addition, the tubular component of the second pump 68*d* can be inserted through the second flow-through opening of the container connection 69 and into the interior of the container 61. Additionally, the base portion 68*a* of the pressure differential device 68 will be positioned within the storage vessel 14, with the base portion 68*a* positioned adjacent to the connection member 14*a* (as shown in broken line in FIG. 6). As such, the second pump 68*d* can create an overpressure in the container 61 to thereby create a pressure differential between the extraction inlet 12*d* and the through-opening 14*c*, causing liquid (and any air within the extraction member 12) to flow through the extraction section 12*a*, through a portion of the transference section 12*b*, through/past the first valve 16*a*, and into the storage vessel 14. It is understood that such an overpressure will provide for the liquid to cause the base portion 68*a* to be shifted away from the connection member 14*a*, such that the liquid will begin to fill the storage vessel 14. It should be understood, however, that certain embodiments may require that the second valve 16*b* comprise components that selectively provide for the second valve 16*b* to operate as a shut-off-type check valve, such that when the valve 16*b* has been closed, no liquid can travel in either direction through/past the valve 16*b*. The second valve 16*b* may be selectively closed or opened manually, such as through a mechanical switch, or automatically, such as through an electronically-activated switch. In embodiments in which the second valve 16*b* is electronically activated, the second valve 16*b* may be controlled by the automated control system that was previously described with respect to liquid extraction apparatus 40 of FIG. 4. When the pump 68*d* is creating an overpressure within the container 61, the valve 16*b* should be in the closed position such that liquid will flow into the storage vessel 14 and will not flow through the second valve 16*b*. Alternatively, if it is desired for liquid in container 61 to flow directly into receptacle 63, then when pump 68*d* is creating an overpressure in container 61, valve 16*b* should be in an open position.

Once liquid has flowed into the storage vessel 14, the first pump 68*c* can create an overpressure within the storage vessel 14 so that the base portion 68*a* is shifted back toward the connection member 14*a*, thereby expelling all of the liquid (and any air) that was received in storage vessel 14. In particular, the liquid will flow out the storage vessel 14, through/past the second valve 16*b*, through a remaining portion of the transference section 12*b*, through the dispenser section 12*c*, out the liquid dispensing outlet 12*f*, and into the receptacle 63. To accomplish such, and in embodiments in which the second valve 16*b* is a shut-off-type check valve, the second valve 16*b* should be shifted to the open position so as to allow liquid to flow through/past the second valve 16*b*. It should be understood that because the valves 16*a*, 16*b* are configured to only allow liquid to flow in a single direction (i.e., from the container 61 to the storage vessel 14 and/or from the storage vessel 14 to the receptacle 63), the liquid that is forced from the storage vessel 14 and into the receptacle 63 will not be allowed to flow past the first valve 16*a* in the direction of the container 61. Furthermore, with the liquid extraction apparatus 60 in the primed configuration, the storage vessel 14 can be re-filled with the liquid from the extraction member 12 and from the container 61 by creating an overpressure within the container 61 via the second pump 68*d*. This time, however, the storage vessel 14 will be filled with liquid that has not been exposed to the external environment (e.g., air).

In the primed configuration, and with the storage vessel 14 filled with the liquid, the liquid extraction apparatus 60 is operable to dispense liquid from the storage vessel 14 into the receptacle 63, simply by causing the base portion 68*a* of the pressure differential device 68 to be shifted toward the connection member 14*a*, via the first pump 68*c*, to expel any liquid stored within the storage vessel 14 into the receptacle 63. In particular, the liquid will flow out the storage vessel 14, through/past the second valve 16*b*, through a remaining portion of the transference section 12*b*, through the dispenser section 12*c*, out the liquid dispensing outlet 12*f*, and into the receptacle 63.

In alternative embodiments, as with the liquid extraction apparatus 40 described above, once the storage vessel 14 of extraction apparatus 60 has been filled with liquid, the storage vessel 14 can alternatively dispense the liquid by removing the storage vessel 14 from the extraction member 12. In such embodiments, a seal device may be placed into or onto connection member 14*a* to block air from contacting the liquid and/or to block the liquid from exiting the storage vessel 14. Any type of common seal device can be used, such as, for example, a rubber or silicone stopper, a plug, a threaded cap, a selectively-actuated valve, or the like. Similarly, a seal device may be placed into or onto connection member 12*g* to block air from contacting the liquid and/or to block the liquid from exiting the extraction member 12. Any type of common seal device can be used, such as, for example, a rubber or silicone stopper, a plug, a selectively-actuated valve, or the like. To dispense the liquid stored in the removed storage vessel 14, the first pump 68*c* can actuate the base portion 68*a* of the pressure differential device 68 to be shifted toward the connection member 14*a* to force some or all of the liquid out through the through-opening 14*c*. In some alternative embodiments, the pressure differential device 68 can be removed from the storage vessel 14 and the liquid can be poured from the storage vessel 14.

In even further alternative embodiments, with the liquid extraction apparatus 60 in the primed configuration, the storage vessel 14 can be removed from the extraction member 12 by disconnecting the connection members 12*g* and 14*a*, and a different storage vessel 14 can be connected to the extraction member 12 to be filled with liquid. In such embodiments, a seal device may be placed into or onto connection member 12*g* to block air from contacting the liquid and/or to block the liquid from exiting the extraction member 12. Any type of common seal device can be used, such as, for example, a rubber or silicone stopper, a plug, a selectively-actuated valve, or the like. As such, a plurality of different storage vessels 14 can be attached to the extraction member 12 and filled with liquid from the container 61. Beneficially, however, each of the different storage vessels 14 will be filled with liquid that has not been exposed to the external environment (e.g., air).

In some alternative embodiments of the liquid extraction apparatus 60, instead of individual pumps 68*c* and 68*d*, a single pump may be used. To accomplish the same functionality as described above, the single air pump may first be removably attached to the container 61 via the container connection 69 so as to provide an overpressure within the container 61 to force liquid into the storage vessel 14. Thereafter, the single air pump can be removed from the container and coupled with the storage vessel 14 so as to provide an overpressure within the storage vessel to force liquid from the storage vessel and into the receptacle 63. Alternatively, the single pump may be simultaneously fluidly connected to each of the container 61 and the storage vessel 14, and the single pump may selectively provide an overpressure to either the container 61 or the storage vessel 14 through use of a directional valve. Furthermore, as previously indicated, the embodiments described herein are not mutually exclusive of one another. As such, for instance, the pump 68*c* may be replaced with the shiftable plunger illustrated in FIG. 1, such that the liquid may be expelled from the storage vessel manually.

Figure 7:
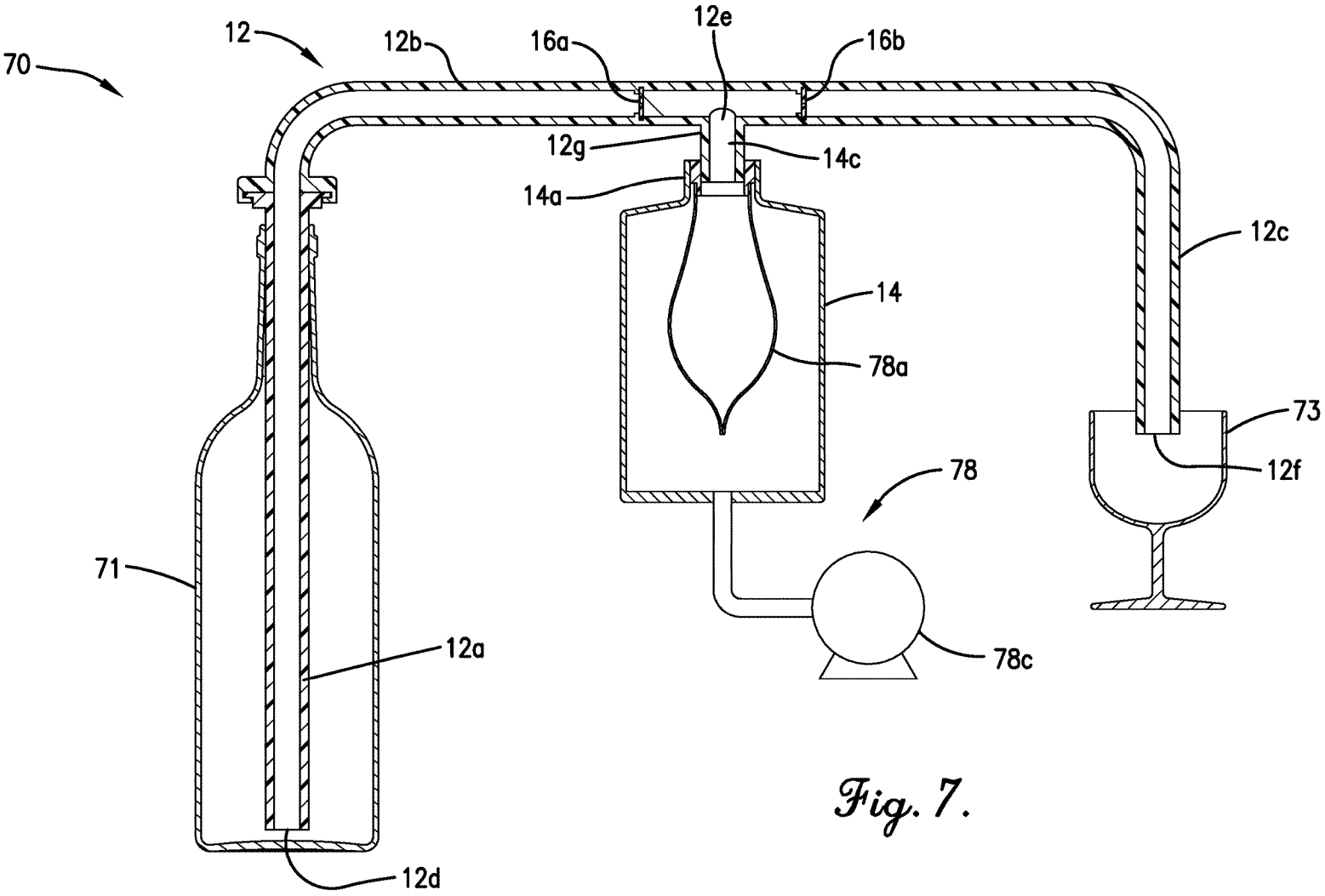
FIG. 7 is an elevational cross-sectional view of a liquid extraction apparatus in accordance with one embodiment of the present invention, particularly illustrating a segmented liquid extraction member partly received inside a container, a pressure differential device comprising an pump fluidly connected to a storage vessel and an expandable pouch received within the storage vessel, and first and second valves received inside the extraction member.

FIG. 7 depicts another embodiment of a liquid extraction apparatus 70 in accordance with the present invention. The liquid extraction apparatus 70 can be used with any liquids or any containers, such as, for example, the liquids and containers related to the liquid extraction apparatuses previously discussed. In certain embodiments, the liquid extraction apparatus 70 will be used with a container 71, which is a wine bottle and which contains wine as the liquid. The liquid extraction apparatus 70 of FIG. 7 may include certain of the same components and characteristics as the liquid extraction apparatus 50 of FIG. 5. For instance, as shown in FIG. 7, the liquid extraction apparatus 70 may include liquid extraction member 12, storage vessel 14, and first and second valves 16*a*, 16*b*, with each of such components being similar (or the same) as the corresponding components from the liquid extraction apparatus 50. Contrastingly, however, the liquid extraction apparatus may 70 may include a pressure differential device 78 that is different from the pressure differential device 58 included in liquid extraction apparatus 50 illustrated in FIG. 5.

In more detail, in place of the base portion 58*a*, the pressure differential device 78 may comprise an expandable pouch 78*a*. As such, the pressure differential device 78 comprises the expandable pouch 78*a* and a pump 78*c*. The expandable pouch 78*a* may be comprised of any flexible or rigid material that is capable of expanding and contracting within the storage vessel 14. For example, the expandable pouch 78*a* can be selected from any sufficiently flexible and water-tight material, such as, for example, plastics, latex, rubber, and/or a rubber-like material. The pump 78*c* may be similar to the pump 58*c* previously described with respect to the liquid extraction apparatus 50 illustrated in FIG. 5. As such, the pump 58*c* may be an air pump or a hydraulic pump that is fluidly connected to the storage vessel 14 on a side opposite of the connection member 14*a*. The pump 58*c* may be configured to provide both an overpressure, i.e., a pressure higher than the pressure at the liquid extraction outlet 12*e*, and an underpressure, i.e., a pressure lower than the pressure at the liquid extraction outlet 12*e*, to the storage vessel 14. As will be described more fully below, such underpressures and overpressures will cause the pouch 78*a* to expand or contract, respectively, so as to force liquid into or out of the storage vessel 14.

In more detail, with the pump 78*c* operating to create an underpressure within the storage vessel 14, the expandable pouch 78*a* will be caused, under the force of the underpressure, e.g., by pumping air out of the storage vessel 14, to expand from an initial size that does not fill a substantial volume of the interior of the storage vessel 14 to a secondary size that fills at least a substantial volume of the internal storage chamber 14*e* of the storage vessel 14. As used herein, the term substantial volume is defined to mean at least 20 percent, at least 30 percent, at least 40 percent, at least 50 percent, or at least 60 percent of the volume of the internal storage chamber 14*e* of the storage vessel 14. Contrastingly, with the pump 78*c* operating to create an overpressure, e.g., by pumping air into the storage vessel 14, the expandable pouch 78*a* will be caused, to contract from the secondary size that fills at least the substantial volume of the internal storage chamber 14*e* of the storage vessel 14 to the initial size that does not fill a substantial volume of the internal storage chamber 14*e* of the storage vessel 14.

In operation, the extraction section 12*a* of the extraction member 12 can be inserted into the container 71 so that the extraction inlet 12*d* is positioned below the surface of the liquid in the container 71. The pump 78*c* can create an underpressure in the storage vessel 14 so as to cause the expandable pouch 78*a* to be shifted from its initial size to its secondary size, to thereby create a pressure differential between the extraction inlet 12*d* and the through-opening 14*c*, causing liquid (and any air within the extraction member 12) to flow through the extraction section 12*a*, through a portion of the transference section 12*b*, through/past the first valve 16*a*, and into the expandable pouch 78*a* and, thus, into the storage vessel 14. It should be understood that although the liquid is held within the expandable pouch 78*a*, because the expandable pouch 78*a* is positioned within the storage vessel 14, the liquid can be considered to be simultaneously held within the expandable pouch 78*a* and the storage vessel 14. Once liquid has begun to flow into the storage vessel 14, the pump 78*c* can create an overpressure within the storage vessel 14 so that the expandable pouch 78*a* is shifted back from its secondary position to its initial position (or a position therebetween), so as to expel some or all of the liquid (and any air) that was received in the expandable pouch 78*a* and, thus, the storage vessel 14. In particular, the liquid will flow out the expandable pouch 78*a* and/or the storage vessel 14, through/past the second valve 16*b*, through a remaining portion of the transference section 12*b*, through the dispenser section 12*c*, out the liquid dispensing outlet 12*f*, and into the receptacle 73. It should be understood that because the valves 16*a*, 16*b* are configured to only allow liquid to flow in a single direction (i.e., from the container 71 to the storage vessel 14 and/or from the storage vessel 14 to the receptacle 73), the liquid that is forced from the expandable pouch 78*a* and/or the storage vessel 14 and into the receptacle 73 will not be allowed to flow past the first valve 16*a* in the direction of the container 71. Furthermore, with the liquid extraction apparatus 70 in the primed configuration, the expandable pouch 78*a* and/or the storage vessel 14 can be re-filled with the liquid from the extraction member 12 and from the container 71 by shifting the expandable pouch 78*a* of from its initial position to its secondary position. This time, however, the expandable pouch 78*a* and/or the storage vessels 14 will be filled with liquid that has not been exposed to the external environment (e.g., air).

In the primed configuration, and with the expandable pouch 78*a* and/or storage vessel 14 filled with the liquid, the liquid extraction apparatus 70 is operable to dispense liquid from the storage vessel 14 into the receptacle 73, simply by causing the expandable pouch 78*a* to be shifted from its secondary position toward its primary position, via the pump 78*c*, to expel some or all of the liquid stored within the expandable pouch 78*a* and/or storage vessel 14 and into the receptacle 73. In particular, the liquid will flow out the storage vessel 14, through/past the second valve 16*b*, through a remaining portion of the transference section 12*b*, through the dispenser section 12*c*, out the liquid dispensing outlet 12*f*, and into the receptacle 73.

In alternative embodiments, as with previous embodiments described above, once the storage vessel 14 of extraction apparatus 70 has been filled with liquid, the storage vessel 14 can alternatively dispense the liquid by removing the storage vessel 14 (including the expandable pouch 78*a*) from the extraction member 12. In such embodiments, a seal device may be placed into or onto connection member 14*a* to block air from contacting the liquid and/or to block the liquid from exiting the storage vessel 14. Any type of common seal device can be used, such as, for example, a rubber or silicone stopper, a plug, a selectively-actuated valve, or the like. Similarly, a seal device may be placed into or onto connection member 12*g* to block air from contacting the liquid and/or to block the liquid from exiting the extraction member 12. Any type of common seal device can be used, such as, for example, a rubber or silicone stopper, a plug, a selectively-actuated valve, or the like. To dispense the liquid stored in the removed storage vessel 14, the pump 78*c* can actuate the expandable pouch 78*a* to force some or all of the liquid out through the through-opening 14*c*. In some alternative embodiments, the pressure differential device 78 can be removed from the storage vessel 14 and the liquid can be poured from the storage vessel 14.

In even further alternative embodiments, with the liquid extraction apparatus 70 in the primed configuration, the storage vessel 14 can be removed from the extraction member 12 by disconnecting the connection members 12*g* and 14*a*, and a different storage vessel 14 (including its own expandable pouch 78*a*) can be connected to the extraction member 12 to be filled with liquid. In such embodiments, a seal device may be placed into or onto connection member 12*g* to block air from contacting the liquid and/or to block the liquid from exiting the extraction member 12. Any type of common seal device can be used, such as, for example, a rubber or silicone stopper, a plug, a selectively-actuated valve, or the like. As such, a plurality of different storage vessels 14 (including their own expandable pouches 78*a*) can be attached to the extraction member 12 and filled with liquid from the container 71. Beneficially, however, each of the different storage vessels 14 and/or expandable pouches 78*a* will be filled with liquid that has not been exposed to the external environment (e.g., air).

Figure 8:
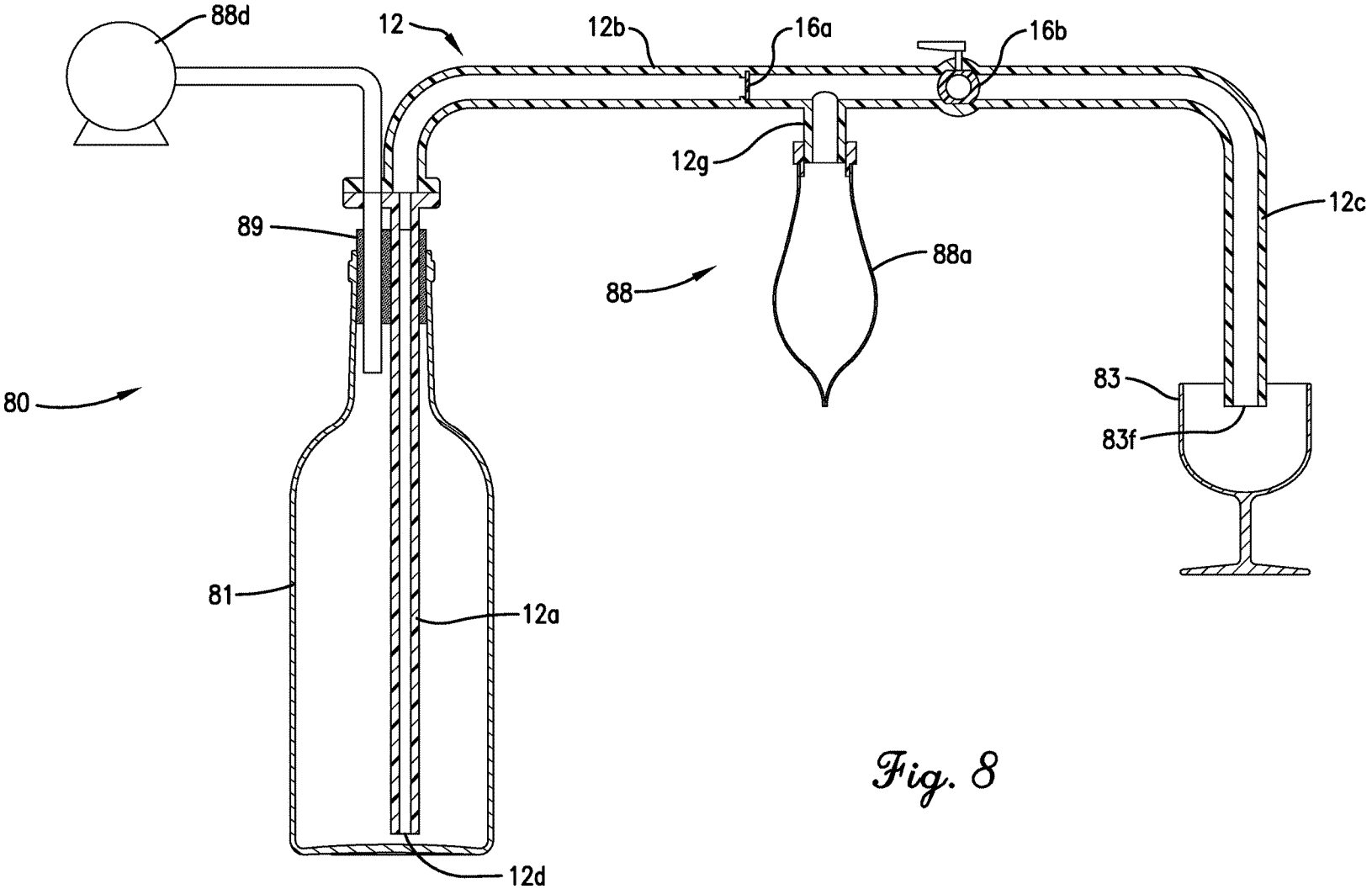
FIG. 8 is an elevational cross-sectional view of a liquid extraction apparatus in accordance with one embodiment of the present invention, particularly illustrating a segmented liquid extraction member partly received inside a container, a pressure differential device comprising a pump fluidly connected to the container and an expandable pouch, and first and second valves received inside the extraction member.

FIG. 8 depicts another embodiment of a liquid extraction apparatus 80 in accordance with the present invention. The liquid extraction apparatus 80 can be used with any liquids or any containers, such as, for example, the liquids and containers related to the liquid extraction apparatuses previously discussed. In certain embodiments, the liquid extraction apparatus 80 will be used with a container 81, which is a wine bottle and which contains wine as the liquid. The liquid extraction apparatus 80 of FIG. 8 may generally comprise a combination of certain of the same components as the liquid extraction apparatus 60 of FIG. 6 and the liquid extraction apparatus 70 of FIG. 7. Particularly, as shown in FIG. 8, the liquid extraction apparatus 80 may include liquid extraction member 12, and first valve 16*a*, with each of such components being similar (or the same) as the corresponding components from the liquid extraction apparatus 60. Contrastingly, however, the liquid extraction apparatus may 80 may include a pressure differential device 88 that comprises a combination of certain components from the pressure differential devices 68, 78 included in liquid extraction apparatuses 60, 70 illustrated in FIGS. 6 and 7.

In more detail, the pressure differential device 88 may include an expandable pouch 88*a*, which is similar or the same as the expandable pouch 78*a* of liquid extraction apparatus 70. In contrast from liquid extraction apparatus 70, the liquid extraction apparatus 80 may not include the storage vessel 14. As such, the expandable pouch 88*a* is configured to act as a storage vessel and individually maintain any liquid extracted from the container 81. In addition, the pressure differential device 88 may include a pump 88*d* (and an associated tubular connection component) and a container connector 89, which such components configured for providing an overpressure within the container 81 so as to facilitate extraction of liquid from the container 81 and into the expandable pouch 88*a*. The pump 88*d* and the container connector 89 may be similar (or the same) as the second pump 68*d* and the container connection 69 of the liquid extraction apparatus 60 of FIG. 6. As such, in some embodiments, the pump 88*d* may comprise an air pump.

In operation, the container connection 89 can be inserted within the opening (i.e., the neck portion) of the container 81. In addition, the extraction section 12*a* of the extraction member 12 can be inserted into the container 81, via a first through-opening of the container connection 89, so that the extraction inlet 12*d* is positioned below the surface of the liquid in the container 81. In addition, the tubular connection component of the pump 88*d* can be inserted through a second flow-through opening of the container connection 89 and into the interior of the container 81.

As such, the pump 88*d* can create an overpressure in the container 81 to thereby create a pressure differential between the extraction inlet 12*d* and the expandable pouch 88*a*, causing liquid (and any air within the extraction member 12) to flow through the extraction section 12*a*, through a portion of the transference section 12*b*, through/past the first valve 16*a*, and into the expandable pouch 88*a*. The expandable pouch 88*a* will expand from an initial size, wherein it contains no liquid, to a secondary size, wherein the expandable pouch 88*a* contains liquid. It is understood that that the secondary size will be greater than the initial size. Additionally, however, certain embodiments may require that the second valve 16*b* of liquid extraction apparatus 80 additionally comprise components that selectively provide for it to operate as a shut-off-type check valve, similar to second valve 16*b* described in liquid extraction apparatus 60. As such, when the valve 16*b* has been closed, no liquid can travel past/through the valve 16*b* in either direction. When the pump 88*d* is creating an overpressure within the container 81, the valve 16*b* should be closed such that liquid will flow into the expandable pouch 88*a* and not through the valve 16*b*.

Once liquid has begun to flow into the expandable pouch 88*a*, the expandable pouch 88*a* may need to be manually compressed, such as by a hand-squeeze, so as to expel all of the liquid (and any air) that was received in the expandable pouch 88*a*. In particular, via such a compression, the liquid will flow out the expandable pouch 88*a*, through/past the second valve 16*b*, through a remaining portion of the transference section 12*b*, through the dispenser section 12*c*, out the liquid dispensing outlet 12*f*, and into the receptacle 83. In embodiments in which the second valve 16*b* is a shut-off-type check valve, the second valve 16*b* should be opened so as to allow liquid to flow through past the second valve 16*b* when dispensing into receptacle 83. It should be understood that because the valves 16*a*, 16*b* are configured to only allow liquid to flow in a single direction (i.e., from the container 81 to the expandable pouch 88*a* and/or from the expandable pouch 88*a* to the receptacle 83), the liquid that is forced from the expandable pouch 88*a* and into the receptacle 83 will not be allowed to flow past the first valve 16*a* in the direction of the container 81. Furthermore, with the liquid extraction apparatus 80 in the primed configuration, the expandable pouch 88*a* can be re-filled with the liquid from the extraction member 12 and from the container 81 by creating an overpressure within the container 81 via the pump 88*d*. This time, however, the expandable pouch 88*a* will be filled with liquid that has not been exposed to the external environment (e.g., air).

In the primed configuration, and with the expandable pouch 88*a* filled with the liquid, the liquid extraction apparatus 80 is operable to dispense liquid from the expandable pouch 88*a* into the receptacle 83, simply by compressing the expandable pouch 88*a*, such as by a hand-squeeze, to expel any liquid stored within the expandable pouch 88*a* into the receptacle 83. In particular, the liquid will flow out the expandable pouch 88*a*, through/past the second valve 16*b*, through a remaining portion of the transference section 12*b*, through the dispenser section 12*c*, out the liquid dispensing outlet 12*f*, and into the receptacle 83. As previously described, it should be understood that the second valve 16*b* will need to be closed while the expandable pouch 88*a* is being filled, and the second valve 16*b* will need to be opened while the expandable pouch 88*a* is being evacuated.

In alternative embodiments, and similar to the storage vessels 14 of previous embodiments described above, once the expandable pouch 88*a* of extraction apparatus 60 has been filled with liquid, the expandable pouch 88*a* can alternatively dispense the liquid by removing the expandable pouch 88*a* from the extraction member 12. In such embodiments, a seal device may be placed into or onto an opening associate with the expandable pouch 88*a* to block air from contacting the liquid and/or to block the liquid from exiting the expandable pouch 88*a*. Any type of common seal device can be used, such as, for example, a rubber or silicone stopper, a plug, a selectively-actuated valve, or the like. Similarly, a seal device may be placed into or onto connection member 12*g* to block air from contacting the liquid and/or to block the liquid from exiting the extraction member 12. Any type of common seal device can be used, such as, for example, a rubber or silicone stopper, a plug, a selectively-actuated valve, or the like. To dispense the liquid stored in the removed expandable pouch 88*a*, the expandable pouch 88*a* may be compressed, such as by a hand-squeeze, to force some or all of the liquid out through the opening of the expandable pouch 88*a*.

In even further alternative embodiments, with the liquid extraction apparatus 80 in the primed configuration, the expandable pouch 88*a* can be removed from the extraction member 12, and different expandable pouches 88*a* can be connected to the extraction member 12 to be filled with liquid. In such embodiments, a seal device may be placed into or onto connection member 12*g* to block air from contacting the liquid and/or to block the liquid from exiting the extraction member 12. Any type of common seal device can be used, such as, for example, a rubber or silicone stopper, a plug, a selectively-actuated valve, or the like. As such, a plurality of different the expandable pouch 88*a* can be attached to the extraction member 12 and filled with liquid from the container 81. Beneficially, however, each of the different expandable pouches 88*a* will be filled with liquid that has not been exposed to the external environment (e.g., air).

Figures 9, 10, 11:
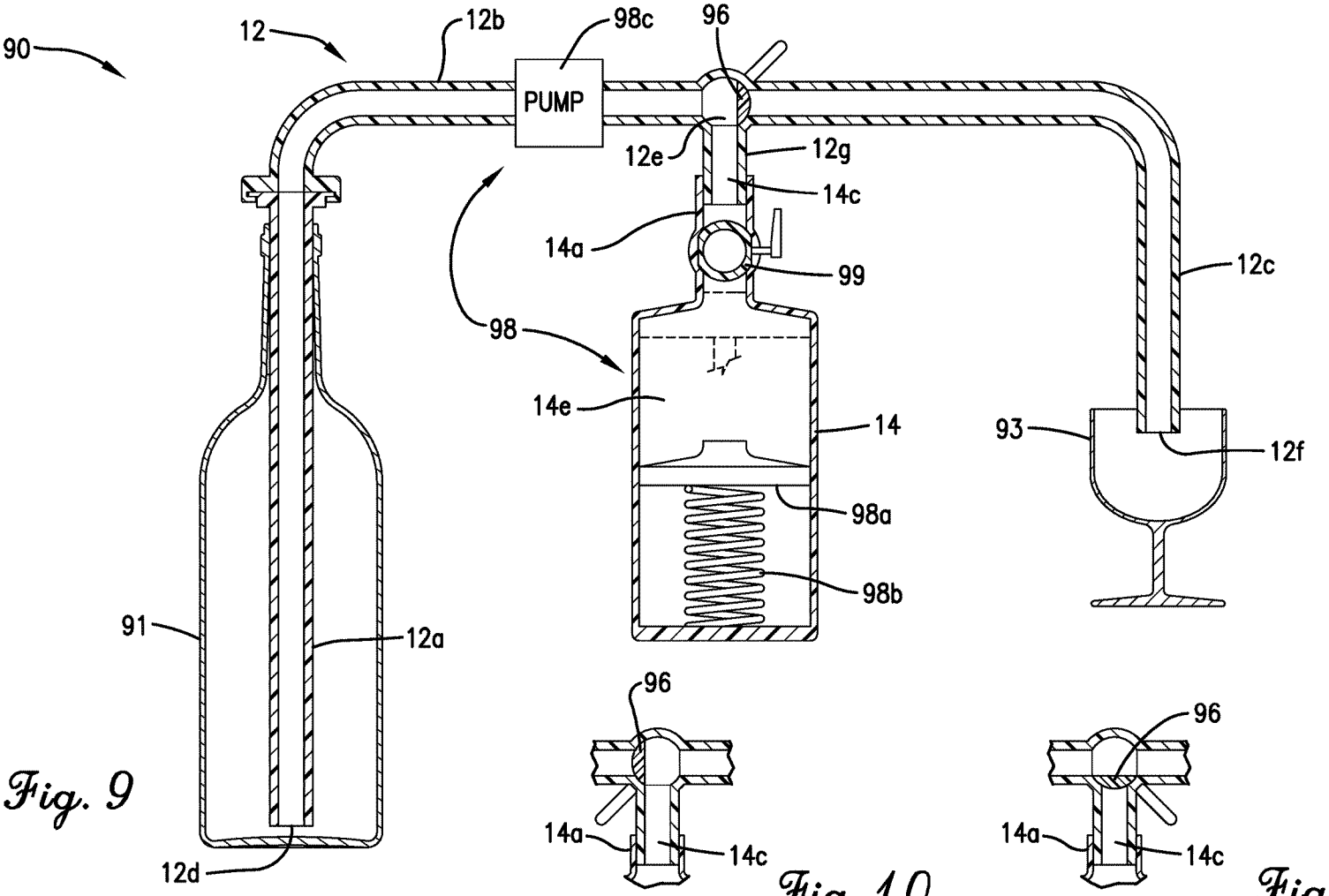
FIG. 9 is an elevational cross-sectional view of a liquid extraction apparatus in accordance with one embodiment of the present invention, particularly illustrating a segmented liquid extraction member partly received inside a container, a pressure differential device comprising a peristaltic pump associated with the liquid extraction member and a shiftable barrier and a spring received within the storage vessel, and multi-port valve in an extracting orientation received inside the extraction member.
FIG. 10 is a partial view of the multi-port valve from FIG. 9 in a first dispensing orientation.
FIG. 11 is a partial view of the multi-port valve from FIGS. 9 and 10 in a second dispensing orientation.

FIG. 9 depicts another embodiment of a liquid extraction apparatus 90 in accordance with the present invention. The liquid extraction apparatus 90 can be used with any liquids or any containers, such as, for example, the liquids and containers related to the liquid extraction apparatuses previously discussed. In certain embodiments, the liquid extraction apparatus 90 will be used with a container 91, which is a wine bottle and which contains wine as the liquid. As will be discussed in more detail below, the liquid extraction apparatus 90 can extract liquid from the container 91 and dispense the liquid into receptacle 93. The liquid extraction apparatus 90 of FIG. 9 may include certain of the same components and characteristics as the liquid extraction apparatuses 40 and 50 of FIGS. 4 and 5, respectively. For instance, as shown in FIG. 9, the liquid extraction apparatus 90 may include liquid extraction member 12 and storage vessel 14, with each of such components being similar (or the same) as the corresponding components from the liquid extraction apparatuses 40 and 50. Contrastingly, however, the liquid extraction apparatus 90 may include a pressure differential device 98 that is different from the pressure differential devices 48 and 58 included in liquid extraction apparatuses 40 and 50 illustrated in FIGS. 4 and 5, respectively. Furthermore, instead of one-way check valves, such as valves 16*a*, 16*b* that may be used in liquid extraction apparatuses 40 and 50, the liquid extraction apparatus 90 may comprise a single multi-port valve 96. In some embodiments, the multi-port valve 96 may include two, three, four, or more port orientations, for directing liquid in two, three, four, or more directions.

In more detail, and with reference to FIG. 9, the pressure differential device 98 comprises a base portion 98*a*, a spring 98*b*, and a pump 98*c*. As with the base portions 48*a* and 58*a* previously-described in relation to liquid extraction apparatus 40 and 50 of FIGS. 4 and 5, respectively, the base portion 98*a* of liquid extraction apparatus 90 can also be comprised of any flexible or rigid material (or any combination thereof) that is capable of creating a pressure differential so as to force liquid out of the storage vessel 14. For example, the base portion 98*a* may include any material that is capable of blocking air and/or liquid from passing through or around the base portion 98*a*, such as, for example, silicone, rubber, and/or a rubber-like material. As such, the base portion 98*a* may be configured to act as a shiftable barrier that is capable of preventing air and/or liquid from entering into the storage vessel 14 and/or from passing from one side of the base portion 98*a* to the other.

The position of the base portion 98*a* can be controlled by the combination of the spring 98*b* and the pump 98*c*, which are configured to actuate the base portion 98*a*. In the embodiments illustrated in FIG. 9, the spring 98*b* may be in the form of compression-style mechanical coil spring formed from stainless steel, or other suitable material. The spring 98*b* may be selected so as to include a spring constant that permits the base portion 98*a* to be compressed away from the connection member 14*a* against the spring 98*b*, such that the internal storage chamber 14*e* of the storage vessel 14 can be filled with liquid from the container 91, and further such that the liquid within the storage vessel 14 can be ejected via a force of the base portion 98*a* as provided by the spring 98*b*. In some other embodiments, in place of a mechanical spring 98*b*, the storage vessel 14 may include fluid (e.g., air) sealed within the storage vessel 14 between the base portion 98*a* and the bottom of the storage vessel 14 (i.e., opposite the connection member 14*a*). With fluid sealed within the storage vessel 14, the fluid can act as a fluid spring (e.g., an air spring) that permits the base portion 98*a* to be compressed away from the connection member 14*a* against the fluid spring, such that the internal storage chamber 14*e* of the storage vessel 14 can be filled with liquid from the container 91, and further such that the liquid within the storage vessel 14 can be ejected via a force of the base portion 98*a* against the liquid, as provided by the force of the fluid spring against the base portion 98*a*. As shown in FIG. 9, the spring 98*b* may be positioned within the storage vessel 14 opposite the connection member 14*a*, such that the base portion 98*a* is positioned between the spring 98*b* and the connection member 14*a*. In certain embodiments, a bottom surface of the base portion 98*a* may be coupled with an end of the spring 98*b*. The pump 98*c* may comprise a reversible peristaltic pump or an inline pump that is fluidly connected to the storage liquid extraction member 12. Alternatively, the pump 98*c* may comprise an air pump fluidly connected to the container 91 and configured to create an overpressure within the container 91, such as was described in previous embodiments. With respect to embodiments in which the pump 98*c* is a peristaltic pump, the pump 98*c* may be positioned between the liquid extraction inlet 12*d* and the liquid extraction outlet 12*e*, so as to form part of the liquid extraction member 12. The pump 98*c* may be electrically powered, such as a by an electric motor. In such embodiments, the pump 98*c* may be controlled via electro-mechanical controls of a control system, such as push-buttons, switches, dials, a touchscreen, or the like. Alternatively, the control system may be entirely automated. In some embodiments, the pump 98*c* may be mechanically powered, such as by a hand-crank. Regardless, the pump 98*c* is configured to pull liquid from the container 91 via peristalsis into the pump 98*c*, and, therefrom, to push the liquid into the storage vessel 14, as will be described in more detail below. By pumping liquid into the storage vessel 14, the base portion 98*a* will be caused to actuate away from the connection member 14*a*, thereby compressing the spring 98*b*.

The multi-port valve 96 may comprise a mechanically or electro-mechanically operated multi-port valve (or a combination of multiple single-port valves) configured to be selectively positioned in one of an extracting orientation (e.g. FIG. 9), a first dispensing orientation (e.g., FIG. 10), and a second dispensing orientation (e.g., FIG. 11). To accomplish each of such orientations, the multi-port valve 96 may be configured to be positioned in various orientations, as illustrated in FIGS. 9-11. In the extracting orientation (i.e., FIG. 9), the multi-port valve 96 is configured to fluidly connect the storage vessel 14 with the pump 98*c* and the container 91. In such an extracting orientation, the storage vessel 14 is fluidly isolated from the receptacle 93 and the portion of the extraction member 12 between the storage vessel 14 and the container 91 may be sealed at the pump 98*c* so as to prevent any liquid that may be held within such portion of the extraction member 12 from travelling back through the extraction member 12 into the container 91. Contrastingly, in the first dispensing orientation (i.e., FIG. 10), the multi-port valve 96 is configured to fluidly connect the storage vessel 14 with the receptacle 93 and to fluidly isolate the storage vessel 14 from the pump 98*c* and the container 91. In such a first dispensing orientation, the portion of the extraction member 12 between the multi-port valve 96 and the container 91 is sealed at the multi-port valve 96 and/or the pump 98*c* so as to prevent any liquid that may be held within such portion of the extraction member 12 from travelling back through the extraction member 12 into the container 91. Finally, in the second dispensing orientation (i.e., FIG. 11), the multi-port valve 96 closes off the storage vessel 14, such that the storage vessel 14 is fluidly isolated from both the container 91 (and the pump 98*c*) and the receptacle 93. In such a second dispensing orientation, the container 91 is fluidly connected to the receptacle 93, such that liquid can be directly transferred from the container 91 to the receptacle 93 under the force of the pump 98*c*.

In operation, the extraction section 12*a* of the extraction member 12 can be inserted into the container 91 so that the extraction inlet 12*d* is positioned below the surface of the liquid in the container 91. In some embodiments, the liquid extraction apparatus 90 may include a container connection (not shown in FIG. 9), which is similar to the container connection 69 of liquid extraction apparatus 60. The container connection may comprise a stopper with a through-hole for receiving the extraction section 12*a* and for keeping the extraction section 12*a* aligned within the container 91. In some embodiments, the container connection may also include a vent hole for equalizing the air pressure within the container 91 with the ambient air pressure as liquid is removed from the container 91. Nevertheless, to continue operation, the multi-port valve 96 can be selectively positioned in the extraction orientation, so as to fluidly connect the storage vessel 14 with the pump 98*c* and the container 91. Additionally, the base portion 98*a* of the pressure differential device 98 will be initially positioned within the storage vessel 14, with the base portion 98*a* positioned adjacent to the connection member 14*a* (as shown in broken line in FIG. 9). As such, the pump 98*c* can pump liquid (and any air within the extraction member 12) from the container 91, through the extraction section 12*a*, through a portion of the transference section 12*b*, through/past the pump 98*c*, through/past the multi-port valve 96, and into the storage vessel 14. As liquid begins to flow into the storage vessel 14, the liquid under pressure from the pump 98*c* causes the base portion 98*a* to shift away from the connection member 14*a* against the spring 98*b*, thereby causing the spring 98*b* to compress. Once liquid has begun to flow into the storage vessel 14, the pump 98*c* can be stopped from pumping liquid into the storage vessel 14, and the multi-port valve 96 can be shifted to the first dispensing orientation. In such a configuration, the storage vessel 14 is fluidly connected with the liquid dispensing outlet 12*f*, such that the base portion 98 will shift back toward the connection member 14*a*, under the force of the spring 98*b*, so to expel all of the liquid (and any air) that was received in storage vessel 14. In particular, the liquid will flow out of the storage vessel 14, through/past the multi-port valve 96, through a remaining portion of the transference section 12*b*, through the dispenser section 12*c*, out the liquid dispensing outlet 12*f*, and into the receptacle 93. It should be understood that because the multi-port valve 96 and/or the pump 98*c* seals the portion of the extraction member 12 between the multi-port valve 96 and the container 91, any liquid previously forced from the container 91 and into the extraction member 12 will be prevented from receding back through the extraction member 12 down into the container 91. As such, the liquid extraction apparatus 90 will be in the primed configuration having liquid (and no air) held within the portion of the extraction member 12 between the multi-port valve 96 and the container 91. In such a primed configuration, the storage vessel 14 can be re-filled with liquid within the extraction member 12 and within the container 91 by shifting the multi-port valve 96 to the extracting orientation and by activating the pump 98*c*. As such, liquid is pumped from the container 91 and into the storage vessel 14 in such a manner that the base portion 98*a* is forced away from the connection member 14*a* and the spring 98*b* is compressed within the storage vessel. This time, however, the storage vessel 14 is filled with liquid that has not been exposed to the external environment (e.g., air). Once the storage vessel 14 has been sufficiently filled with liquid, the multi-port valve 96 can be shifted to the second dispensing orientation, such that storage vessel 14 is fluidly sealed from both the container 91 (and the pump 98*c*) and the receptacle 93. If the pump then continues to run, liquid that remained in the container can be transferred through the extraction inlet 12*d*, past the pump 98*c*, past the multiport valve 96, through the dispenser section 12*c* and into the receptacle 93.

In an alternative operational embodiment, liquid from the container 91 may not be required to be first extracted from the container 91 and into the storage vessel 14 for purposes of configuring the liquid extraction system 90 in the primed configuration. In more detail, the extraction section 12*a* of the extraction member 12 can be inserted into the container 91 so that the extraction inlet 12*d* is positioned below the surface of the liquid in the container 91, as was described above. The multi-port valve 96 can be selectively positioned in the second dispensing orientation, so as to fluidly connect the receptacle 93 with the pump 98*c* and the container 91. As such, the pump 98*c* can pump liquid (and any air within the extraction member 12), via peristaltic action, from the container 91, through the extraction section 12*a*, through the transference section 12*b*, through/past the pump 98*c*, through/past the multi-port valve 96, through the dispenser section 12*c*, and into the receptacle 93. As liquid begins to flow into the receptacle 93, the multi-port valve 96 can be shifted to the extraction orientation or to the first dispensing orientation. The pump may optionally be stopped during said shifting. It should be understood that because the multi-port valve 96 and/or the pump 98*c* seals the portion of the extraction member 12 between the multi-port valve 96 and the container 91, any liquid forced from the container 91 and into the extraction member 12 will be prevented from receding back through the extraction member 12 down into the container 91. As such, the liquid extraction apparatus 90 will be in the primed configuration having liquid (and no air) held within the portion of the extraction member 12 between the multi-port valve 96 and the container 91. In such a primed configuration, the storage vessel 14 can be filled with liquid within the extraction member 12 and within the container 91 by shifting the multi-port valve 96 to the extracting orientation (if it was not already in the extracting orientation) and by re-activating the pump 98*c* (if it had previously been stopped). As such, liquid is pumped from the container 91 and into the storage vessel 14 in such a manner that the base portion 98*a* is forced away from the connection member 14*a* and the spring 98*b* is compressed within the storage vessel. The storage vessel 14 is, thus, filled with liquid that has not been exposed to the external environment (e.g., air). Upon completion of filling the storage vessel 14 with a desired amount of liquid, the multi-port valve 96 can be shifted to the second dispensing orientation, such that any remaining liquid in the container 91 can be sent to the receptacle 93. Given the operation described above, the storage vessel 14 can be filled with liquid that has not contacted the external environment, while any liquid that was in the container 91 and that may been exposed to the external environment (e.g., the first portion and the last portion of the liquid extracted from the container 91) will be sent to the receptacle 93 for immediate consumption. A similar operation is possible for priming the liquid extraction apparatuses 60 and 80 of FIGS. 6 and 8.

With the storage vessel 14 filled with liquid, the liquid extraction apparatus 90 is operable to either (1) immediately dispense liquid from the storage vessel 14 into the receptacle 93, or (2) store the liquid within the storage vessel for future dispensing. To immediately dispense the liquid, the multi-port valve 96 can be shifted to the first dispensing orientation, thereby causing the base portion 98*a* to be shifted toward the connection member 14*a*, via the force of the spring 98*b*, to expel any liquid stored within the storage vessel 14 into the receptacle 93. As such, the liquid will flow out the storage vessel 14, through/past the multi-port valve 96, through a remaining portion of the transference section 12*b*, through the dispenser section 12*c*, out the liquid dispensing outlet 12*f*, and into the receptacle 93. The multi-port valve 96 may be held open until the entire amount of liquid within the storage vessel 14 has been dispensed, or alternatively, at any time during the dispensing of the liquid from the storage vessel 14, the multi-port valve 96 can be shifted to the second dispensing orientation so as to cut-off the liquid from being dispensed from the storage vessel 14. In the second dispensing orientation, the base portion 98*a* will remain generally in a stationary position, with the pressure of the liquid within the storage vessel being counterbalanced by the force of the spring 98*b* and the sealed position of the multi-port valve 96. Alternatively, the storage vessel 14 may, in some embodiments, have an internal shut-off type stop valve 99 (See FIG. 9), which can selectively seal and unseal access to the interior storage chamber 14*e*. As such, to cut-off the liquid from being dispensed from the storage vessel 14, internal shut-off valve 99 may be selectively actuated to the sealed position.

To store the liquid within the storage vessel 14 for future dispensing, the storage vessel 14 can optionally be removed from the extraction member 12, similar to previous descriptions related to the liquid extraction apparatuses 40 and 50. In such embodiments, a seal device may be placed into or onto connection member 14*a* to block air from contacting the liquid and/or to block the liquid from exiting the storage vessel 14. Any type of common seal device can be used, such as, for example, a rubber or silicone stopper, a plug, a selectively-actuated valve, or the like. Alternatively, as described above, the storage vessel 14 may have its own internal shut-off valve 99 (See FIG. 9), which can selectively seal and unseal the interior storage chamber 14*e*. Furthermore, once the storage vessel 14 has been removed from the extraction member 12, a seal device may be placed into or onto connection member 12*g* to block air from contacting the liquid and/or to block the liquid from exiting the extraction member 12. Any type of common seal device can be used, such as, for example, a rubber or silicone stopper, a plug, a selectively-actuated valve, or the like. As such, the storage vessel 14 can be removed, such that the liquid within the storage vessel 14, which has not been in contact with the external environment (e.g., air), can be stored for an extended period, such as weeks, months, or years.

To thereafter dispense the liquid stored in the removed storage vessel 14, the seal device can be removed from the storage vessel 14 and/or the shut-off valve 99 can be actuated to the open position, such that the spring 98*b* can actuate the base portion 98*a* towards the connection member 14*a* to force some or all of the liquid out through the through-opening 14*c*. In some alternative embodiments, the base portion 98*a* and/or the spring 98*b* of the pressure differential device 98 can be removed from the storage vessel 14 and the liquid can be poured from the storage vessel 14.

In further alternative embodiments, with the liquid extraction apparatus 90 in the primed configuration, the original storage vessel 14 can be removed from the extraction member 12 by disconnecting the connection members 12*g* and 14*a*, and a different storage vessel 14 can be connected to the extraction member 12 to be filled with liquid. In such embodiments, a seal device may be placed into or onto connection member 12*g* to block air from contacting the liquid and/or to block the liquid from exiting the extraction member 12. Any type of common seal device can be used, such as, for example, a rubber or silicone stopper, a plug, a selectively-actuated valve, or the like. In further alternatives, a stop valve (not shown) could be positioned within the connection member 12*g* to selectively seal and unseal the connection member 12*g*. As such, a plurality of different storage vessels 14 can be attached to the extraction member 12 and filled with liquid from the container 91. Beneficially, however, each of the different storage vessels 14 will be filled with liquid that has not been exposed to the external environment (e.g., air). As provided above, liquid can be dispensed from each of the storage vessels 14 either by (1) removing the sealing devices from and/or opening the shut-off valves 99 of the storage vessels 14 that have been removed from the extraction member 12 or, (2) by shifting the multi-port valve 96 to the first dispensing orientation for the storage vessel 14 that is coupled with the extraction member 12.

In certain embodiments, the above-described filling of and dispensing from the storage vessel 14 can be at least partially automated. For instance, the pump 98*c*, the multi-port valve 96, and/or the internal shut-off valve 99 can each be controlled via an electrical and/or an electro-mechanical control system. As such, once the extraction section 12*a* of the extraction member 12 has been inserted into the container 91, the control system can shift the multi-port valve 96 into the extracting orientation and can cause the pump 96*c* to begin pumping liquid from the container 91 into the storage vessel 14. As described above, the amount of liquid initially pumped into the storage vessel 14 may only be enough to ensure that all of the air within the portion of the extraction member 12 between the storage vessel 14 and the container 91 has been forced into the storage vessel 14. In some embodiments, the amount of liquid initially pumped into the extraction member 14 may be no more than 20 percent, no more than 10 percent, no more than 5 percent, or no more than 1 percent of a total volume of liquid originally held within the container 91. In certain embodiments, the control system may be programmed to command the pump 98*c* to actuate for a predetermined amount of time such that that the appropriate amount of liquid has been initially removed from the container 91 so as to ensure that generally all of the air within the extraction member 12 has been forced into the storage vessel 14. Thereafter, the control system may instruct the pump 98*c* to stop pumping liquid from the container 91 and for the multi-port valve 96 to shift to the first dispensing orientation, such that the liquid (and any air) within the storage vessel 14 is dispensed into the receptacle 93. With liquid (and no air) within the portion of the extraction member 12 between the multi-port valve 96 and the container 91, the liquid extraction apparatus 90 is in the primed configuration. To alternatively place the liquid extraction apparatus 90 in the primed configuration, instead of extracting an initial portion of liquid from the container 91 to the storage vessel 14, the control system could initially shift the multi-port valve 96 to the second dispensing orientation and, thereafter, cause the pump 96*c* to begin pumping liquid from the container 91 directly into the receptacle 93. Once an initial portion of liquid has been pumped into the receptacle 93, the control system can shift the multi-port valve 96*c* into the extracting orientation, such that the liquid extraction apparatus 90 is in the primed configuration. As previously discussed, in the primed configuration, the storage vessel 14 can be filled with liquid from the container 91 that has not been exposed to air simply by insuring the multi-port valve 96 is in the extracting orientation and activating the pump 98*c*.

Furthermore, the dispensing of the liquid from the filled storage vessel 14 can be at least partially automated. In particular, once the storage vessel 14 has been filled with an amount of liquid, a specific amount of the liquid can be dispensed into the receptacle 93. To accomplish such, the control system may control the multi-port valve 96 via a timing mechanism that instructs the multi-port valve 96 to be positioned in the first dispensing orientation for a given amount of time. The given amount of time may correspond to a given volume of liquid that will be dispensed from the storage vessel 14. For instance, if the storage vessel 14 contains approximately 750 mL of liquid, a user of embodiments of the present invention may select, via a pushbutton, a dial, a touchscreen, or the like, for the liquid extraction apparatus 90 to dispense 1 glass of the liquid equaling approximately 150 mL of liquid. As such, the control system may instruct the multi-port valve 96 to shift from the second dispensing orientation to the first dispensing orientation for a specific amount of time that corresponds to 150 mL being dispensed from the storage vessel 14 to the receptacle 93. After the specific amount of time has transpired, the control system may instruct the multi-port valve 96 to shift back to the second dispensing orientation to seal the remaining amount of liquid within the storage vessel 14. Alternatively, the liquid extraction apparatus 90 may include one or more sensors for measuring the amount of liquid being extracted or dispensed. Such sensors may comprise for instance, mechanical flow meters (e.g., piston meters, gear meters, etc.), pressure meters (e.g., venture meter, pitot tube, etc.), optical flow meter (e.g., laser-based meters or other optical sensors), electrical flow meters (e.g., magnetic, Doppler, etc.).

Figure 12:
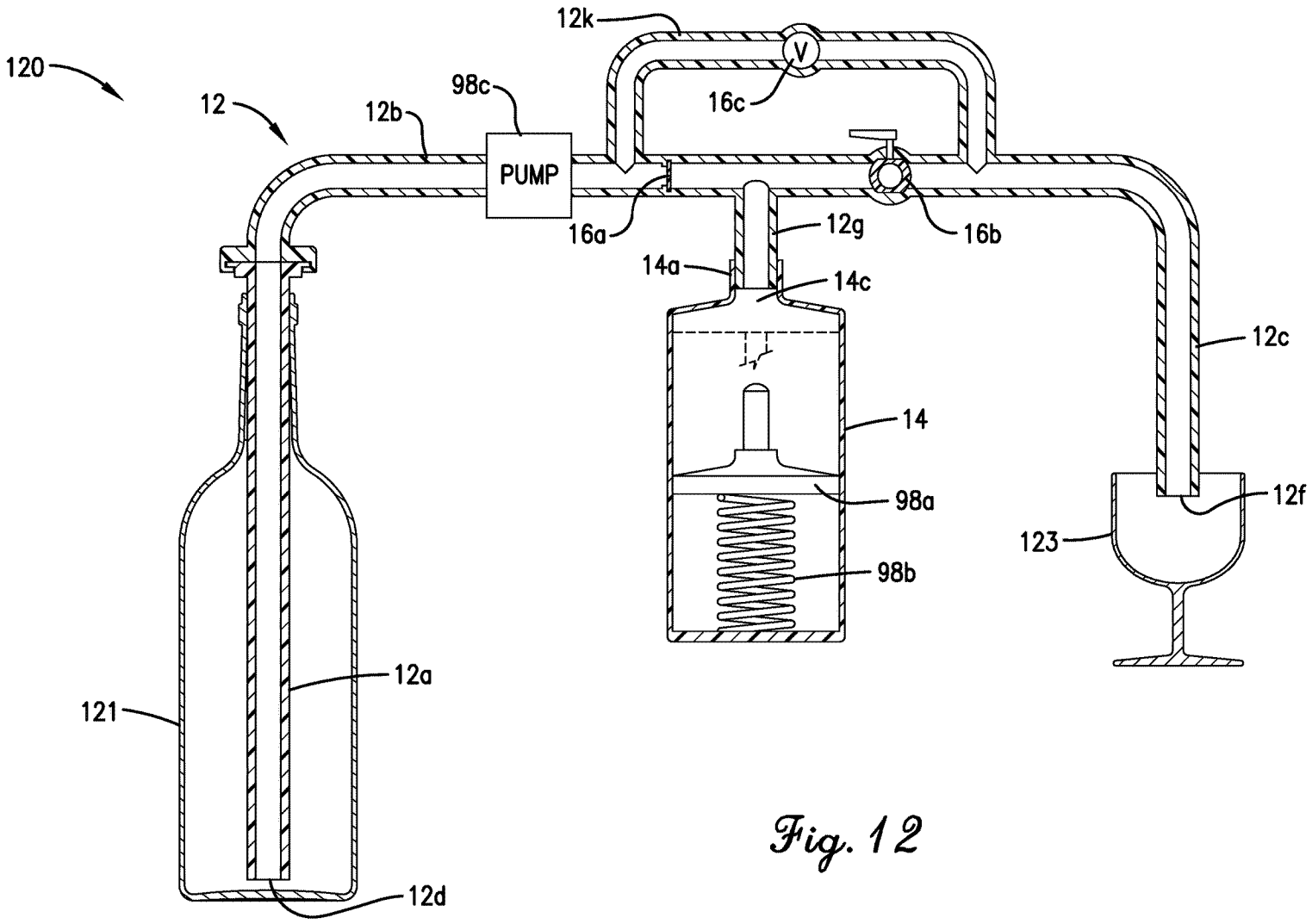
FIG. 12 is an elevational cross-sectional view of a liquid extraction apparatus in accordance with one embodiment of the present invention, particularly illustrating a liquid extraction member with a pressure relief section.

FIG. 12 depicts another embodiment of a liquid extraction apparatus 120 in accordance with the present invention. The liquid extraction apparatus 120 can be used with any liquids or any containers, such as, for example, the liquids and containers related to the liquid extraction apparatuses previously discussed. In certain embodiments, the liquid extraction apparatus 120 will be used with a container 121, which is a wine bottle and which contains wine as the liquid. As will be discussed in more detail below, the liquid extraction apparatus 120 can extract liquid from container 121 and dispense the liquid into receptacle 123. The liquid extraction apparatus 120 of FIG. 12 may include certain of the same components and characteristics as the liquid extraction apparatuses 90 of FIG. 9. For instance, as shown in FIG. 12, the liquid extraction apparatus 120 may include liquid extraction member 12 and storage vessel 14, with each of such components being similar (or the same) as the corresponding components from the liquid extraction apparatus 90. Contrastingly, however, the liquid extraction apparatus 120 may include, in place of a single multi-port valve 96, a first valve 16*a* in the form of a one-way check valve and a second valve 16*b* which may be in the form of a shut-off type valve (similar to the configuration of apparatus 60 shown in FIG. 6). Valve 16*b* may optionally be in the form of a mechanical or electro-mechanical valve capable of automatically permitting the passage of gas and blocking the passage of liquid. In addition, the apparatus 120 may include a pressure relief path 12*k* running in parallel with a portion of the transference section 12*b*.

The pressure relief section 12*k* may have an inlet extending from the transference section 12*b* between the pump 98*c* and the second valve 16*b*. The pressure relief section 12*k* may extend to an outlet between the second valve 16*b* and the liquid dispensing outlet 12*f*. The pressure relief section 12*k* includes a third valve 16*c* in the form of a pressure relief valve. The third valve 16*c* may be configured to permit liquid to flow from the inlet to the outlet of the pressure relief section 12*k* only if a cracking pressure exists between the inlet and the outlet. The cracking pressure may be selected as necessary for particular application, but may, in some embodiments be between 25 and 5 p.s.i., between 20 and 10 p.s.i., or about 15 p.s.i.

In operation of the apparatus 120, the extraction section 12*a* of the extraction member 12 can be inserted into the container 121 so that the extraction inlet 12*d* is positioned below the surface of the liquid in the container 121. In some embodiments, the liquid extraction apparatus 120 may include a container connection (not shown in FIG. 120), which is similar to the container connection 69 of liquid extraction apparatus 60. The container connection may comprise a stopper with a through-hole for receiving the extraction section 12*a* and for keeping the extraction section 12*a* aligned within the container 121. In some embodiments, the container connection may also include a vent hole for equalizing the air pressure within the container 121 with the ambient air pressure as liquid is removed from the container 121. Nevertheless, to continue operation, the second valve 16*b* can be selectively positioned in the open position, so as to fluidly connect the storage vessel 14 with the pump 98*c* (in the form of a peristaltic or inline pump), the container 121, and the liquid dispensing outlet 12*f*. As such, the pump 98*c* can pump liquid from the container 121 through the extraction section 12*a*, through a portion of the transference section 12*b*, through/past the pump 98*c*, through past the first valve 16*a*, and to the storage vessel 14, such that the liquid extraction apparatus 120 is in the primed configuration. In particular, the liquid extraction apparatus 120 will be in the primed configuration when liquid (and no air) is held within the portion of the extraction member 12 between the container 121 and the storage vessel 14.

With the liquid extraction apparatus 120 in the primed configuration, the second valve 16*b* can be shifted to the closed position. Thereafter, the pump 98*c* can pump liquid from the container 121 to within the storage vessel 14. Initially, the base portion 98*a* of the pressure differential device 98 will be positioned within the storage vessel 14, with the base portion 98*a* positioned adjacent to the connection member 14*a* (as shown in broken line in FIG. 12). As such, the pump 98*c* can pump liquid from the container 121, through the extraction section 12*a*, through a portion of the transference section 12*b*, through/past the pump 98*c*, through/past the first valve 16*a*, and into the storage vessel 14. As liquid begins to flow into the storage vessel 14, the liquid under pressure from the pump 98*c* causes the base portion 98*a* to shift away from the connection member 14*a*, thereby causing the spring 98*b* to compress. Beneficially, the storage vessel 14 is filled with liquid that has not been exposed to the external environment (e.g., air). The storage vessel 14 will continue to be filled until it is full. At such time, the pressure within the liquid extraction apparatus 120 will increase to a level exceeding the cracking pressure of the third valve 16*c* within the pressure relief section 12*k*, such that liquid will begin to flow from the container 121, through the pressure relief section 12*k*, and to the receptacle 123. The liquid that was filled in the storage vessel 14 will be prevented from leaving the storage vessel 14 by the first valve 16*a* and the second valve 16*b*.

The liquid extraction apparatus 120 can be configured in a manner so as to permit the entire contents or a portion of a specific container 121 to be stored within the storage vessel 14 and/or extracted into the receptacle 123. For example, when the container 121 is a wine bottle, the liquid extraction apparatus 120 may be configured to initially store all but one glass of liquid from the wine bottle within the storage vessel 14, such that the remaining one glass of liquid can be sent to the receptacle 123 for immediate consumption. Some portion of said one glass of liquid may travel through the pressure relief path 12*k* and another portion may pass through the entirety of the transference section 12*b* without entering the pressure relief path 12*k*. In addition, pressure relief section 12*k* may be operable to act as a safety mechanism to provide a safety outlet for liquid to flow during an overpressure within the liquid extraction apparatus 120.

With the storage vessel 14 filled with liquid, the liquid extraction apparatus 120 is operable to either (1) further dispense liquid from the storage vessel 14 into the receptacle 123, or (2) store the liquid within the storage vessel 14 for future dispensing. To further dispense the liquid for immediate consumption, the second valve 16*b* can be shifted to the open position, thereby causing the base portion 98*a* to be shifted toward the connection member 14*a*, via the force of the spring 98*b*, to expel liquid stored within the storage vessel 14 into the receptacle 123. As such, the liquid will flow out the storage vessel 14, through/past the second valve 16*b*, through a remaining portion of the transference section 12*b*, through the dispenser section 12*c*, out the liquid dispensing outlet 12*f*, and into the receptacle 123. It is understood that the first valve 16*a* prevents the liquid stored within the vessel 14 from exiting in an opposite direction through the transference section 12*b*. The second valve 16*b* may be held open until the entire amount of liquid within the storage vessel 14 has been dispensed, or alternatively, at any time during the dispensing of the liquid from the storage vessel 14, the second valve 16*b* can be closed so as to cut-off the liquid from being dispensed from the storage vessel 14. With the second valve 16*b* in the closed position, the base portion 98*a* will remain generally in a stationary position, with the pressure of the liquid within the storage vessel being counterbalanced by the force of the spring 98*b* and the first and second valves 16*a,b*.

To store the liquid within the storage vessel 14 for future dispensing, the storage vessel 14 can optionally be removed from the extraction member 12, similar to the liquid extraction apparatuses previously described herein. In such embodiments, a seal device may be placed into or onto connection member 14*a* to block air from contacting the liquid and/or to block the liquid from exiting the storage vessel 14. Any type of common seal device can be used, such as, for example, a rubber or silicone stopper, a plug, a selectively-actuated valve, or the like. Once the storage vessel 14 has been removed from the extraction member 12, a seal device may be placed into or onto connection member 12*g* to block air from contacting the liquid and/or to block the liquid from exiting the extraction member 12. Any type of common seal device can be used, such as, for example, a rubber or silicone stopper, a plug, a selectively-actuated valve, or the like. As such, the storage vessel 14 can be removed, such that the liquid within the storage vessel 14, which has not been in contact with the external environment (e.g., air), can be stored for an extended period, such as weeks, months, or years. To thereafter dispense the liquid stored in the removed storage vessel 14, the seal device can be removed from the storage vessel 14, such that the spring 98*b* can actuate the base portion 98*a* towards the connection member 14*a* to force some or all of the liquid out through the through-opening 14*c*. In some alternative embodiments, the base portion 98*a* and/or the spring 98*b* of the pressure differential device 98 can be removed from the storage vessel 14 and the liquid can be poured from the storage vessel 14.

Figure 14:
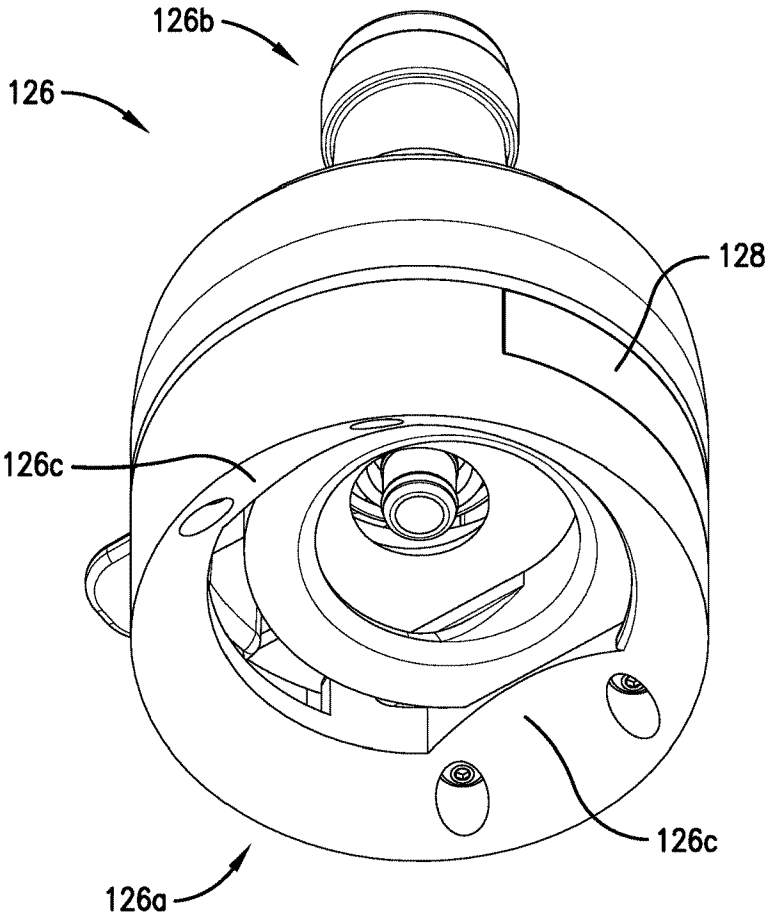
FIG. 14 is bottom perspective view of the dispensing topper from FIG. 13.
Figure 13:
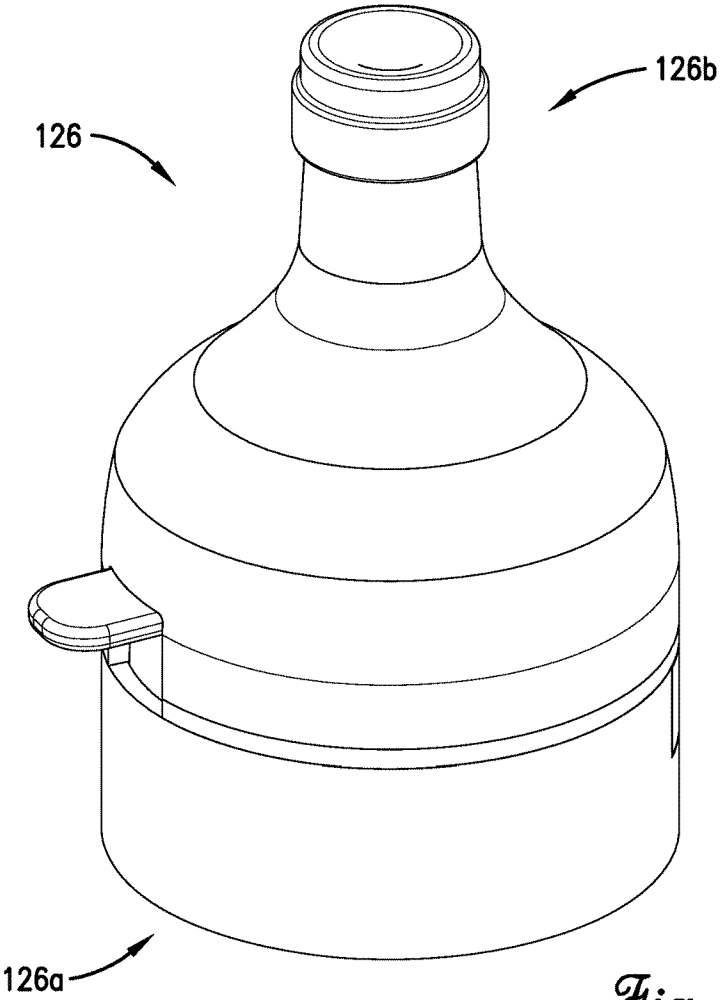
FIG. 13 is a top perspective view of a dispensing topper according to embodiments of the present invention, with the dispensing topper configured to be sealingly secured to a storage vessel and configured to selectively dispense liquid from the storage vessel.
Figure 15:
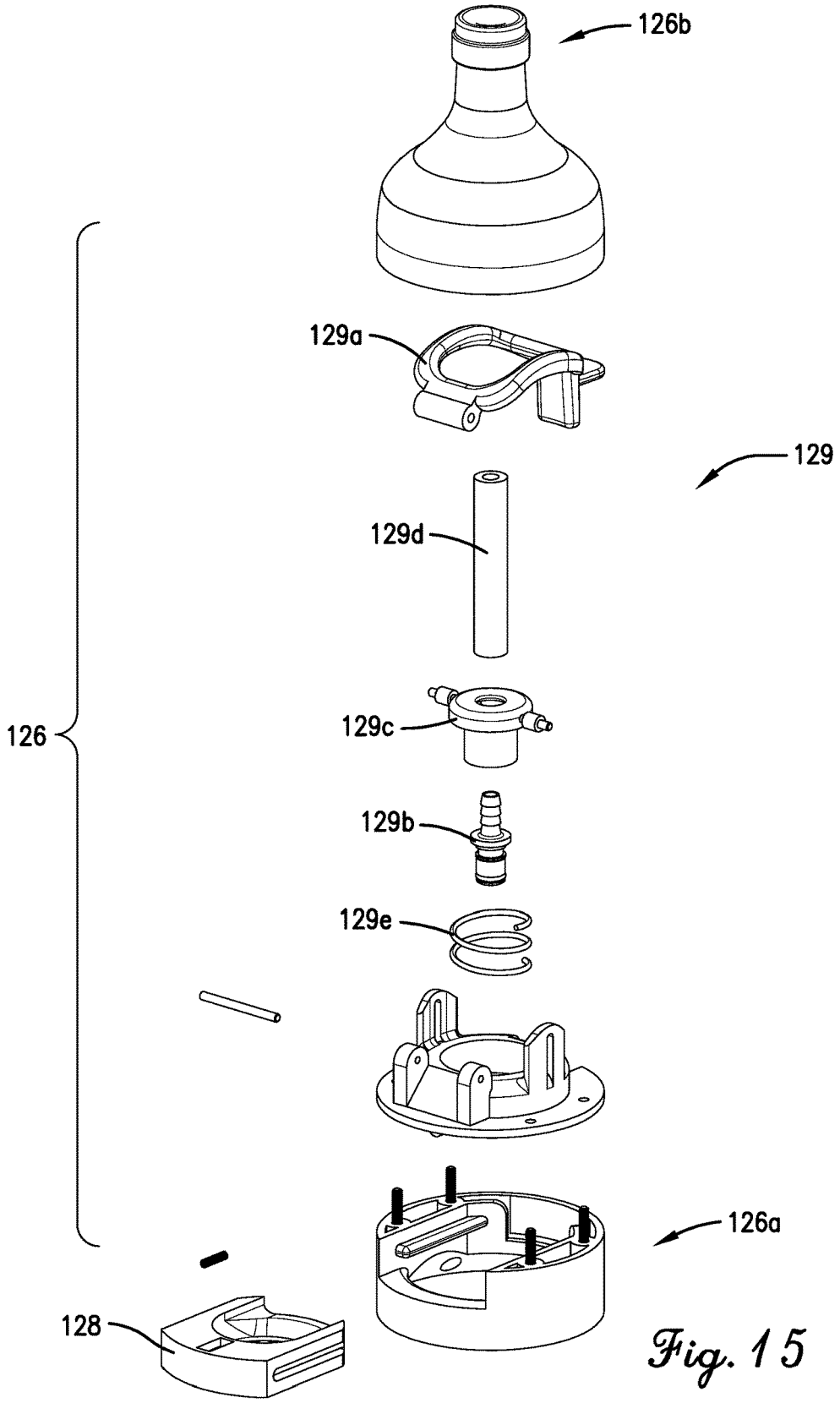
FIG. 15 is an exploded view of the dispensing topper from FIGS. 13-14.

In further alternative embodiments, embodiments of the present invention may include a dispensing topper. One possible embodiment of said dispensing topper is illustrated in FIGS. 13-15, which is configured to be attached to the storage vessel 14, and which functions to permit selective dispensing of liquid from the vessel 14. In more detail, the dispensing topper 126 includes a latching end 126*a* and a dispensing end 126*b*. The latching end 126*a* presents an opening and is configured to be securably and sealably attached to the connection member 14*a* of a storage vessel 14. The dispensing end 126*b* is configured to selectively dispense liquid from the storage vessel 14, as will be described in more detail below.

The latching end 126*a* includes a spring-loaded latching mechanism 128, as perhaps best shown in FIG. 15. The latching mechanism 128 comprises a framed structure presenting a generally circular opening for receiving the connection member 14*a* of a storage vessel 14 (See, e.g., FIG. 14). The latching mechanism 128 is slidably engaged with a base of the dispensing topper 126, via a lateral-orientated receiving area positioned adjacent to the latching end 126*a*. Springs (not shown) associated with the latching mechanism 128 function to maintain the latching mechanism 128 in a generally centered position with respect to the base of the dispensing topper 126, as is illustrated in FIG. 14. With the latching mechanism 128 in such a centered position, a central axis of the latching mechanism 128 (passing through a center of the circular opening of the latching mechanism 128) is generally aligned with a central axis of the dispensing topper 126 (passing through a center of the latching end 126*a* of the dispensing topper 126). As shown in FIG. 14, the latching end 126*a* of the dispensing topper 126 includes a pair of opposing protuberances 126*c*, which extend inward into the opening of the latching end 126*a*, thereby reducing an internal diameter of the opening of the latching end 126*a* near the center of such opening. When the latching mechanism 128 is in the centered position, the center of the latching mechanism 128 is generally aligned between the protuberances 126*c*.

To secure the dispensing topper 126 onto a storage vessel 14, the latching mechanism 128 is depressed within the receiving area, such that the latching mechanism 128 is not in the centered position, and the center of the latching mechanism 128 is out of alignment between the protuberances 126*a*. As such, the connection member 14*a* of a storage vessel 14 can be inserted within the opening presented by the latching mechanism 128. Thereafter, the depression of the latching mechanism 128 can be released, such that the latching mechanism 128 returns (under the force of its springs) to the centered position with respect to the latching end 126*a* of the dispensing topper 126. In such a centered position, the center of the latching mechanism 128 is aligned between the protuberances 126*c*. With the connection member 14*a* received within the opening of the latching mechanism 128, the protuberances 126*c* function, by reducing the internal diameter of the opening of the latching end 126*a* near the center of the opening, to sealingly secure the connection member 14*a*, and thus the storage vessel 14, to the latching end 126*a* of the dispensing topper 126. To remove the storage vessel 14 from the dispensing stopper 126, the latching mechanism 128 can again be depressed such that it is not in the centered position and is out of alignment between the protuberances 126*a*. As such, the connection member 14*a* can be removed from within the opening of the latching mechanism 128 and from the dispensing topper 126.

With the dispensing topper 126 secured to the connection member 14*a* of the storage vessel 14, liquid can be selectively dispensed from the storage vessel 14. In more detail, the dispensing topper 126 includes a dispensing assembly 129, as illustrated in FIG. 15, which includes a lever 129*a*, a male quick connector ("QD") 129*b*, a female QD 129*c*, a conduit 129*d*, and spring 129*e*. Upon the dispensing topper 126 being secured to the connection member 14*a* of the storage vessel 14, the male QD 129*b* is frictionally fit (in a sealed manner) within the through-opening 14*c* of the storage vessel's 14 connection member 14*a*. The male QD 129*b* is configured to restrict liquid form flowing through the male QD 129*b*, and thus from the storage vessel 14, unless the male QD 129*b* is connected with the female QD 129*c*. Generally, the female QD 129*c* is retained in an upward position, separated from the male QD 129*b*, by the spring 129*e*. As such, the dispensing assembly 129 is generally configured to prevent liquid from being dispensed from the storage vessel 14. However, a user can depress the lever 129*a*, which will force the female QD 129*c* down into connection with the male QD 129*b* so as to permit liquid to flow from the storage vessel 14. In particular, with the level 129*a* depressed and the storage vessel 14 inverted or tipped, liquid can flow from the storage vessel 14 through the male QD 129*b*, through the female QD 129*c*, through the conduit 129*d*, and out the dispensing end 126*b* of the dispensing topper 126. It being understood that the conduit 129*d* fluidly connects the female QD 129*c* with the dispensing end 126*b* of the dispensing topper 126. To stop the flow of liquid from the storage vessel 14, the user can release the handle 129*a*, such that the female QD129*c* is disconnected from the male QD 129*b* (under the force of the spring 129*e*), which thereby prevents liquid from flowing through the male QD 129*b* inserted within the through-opening 14*c* of the storage vessel 14.

Figure 16:
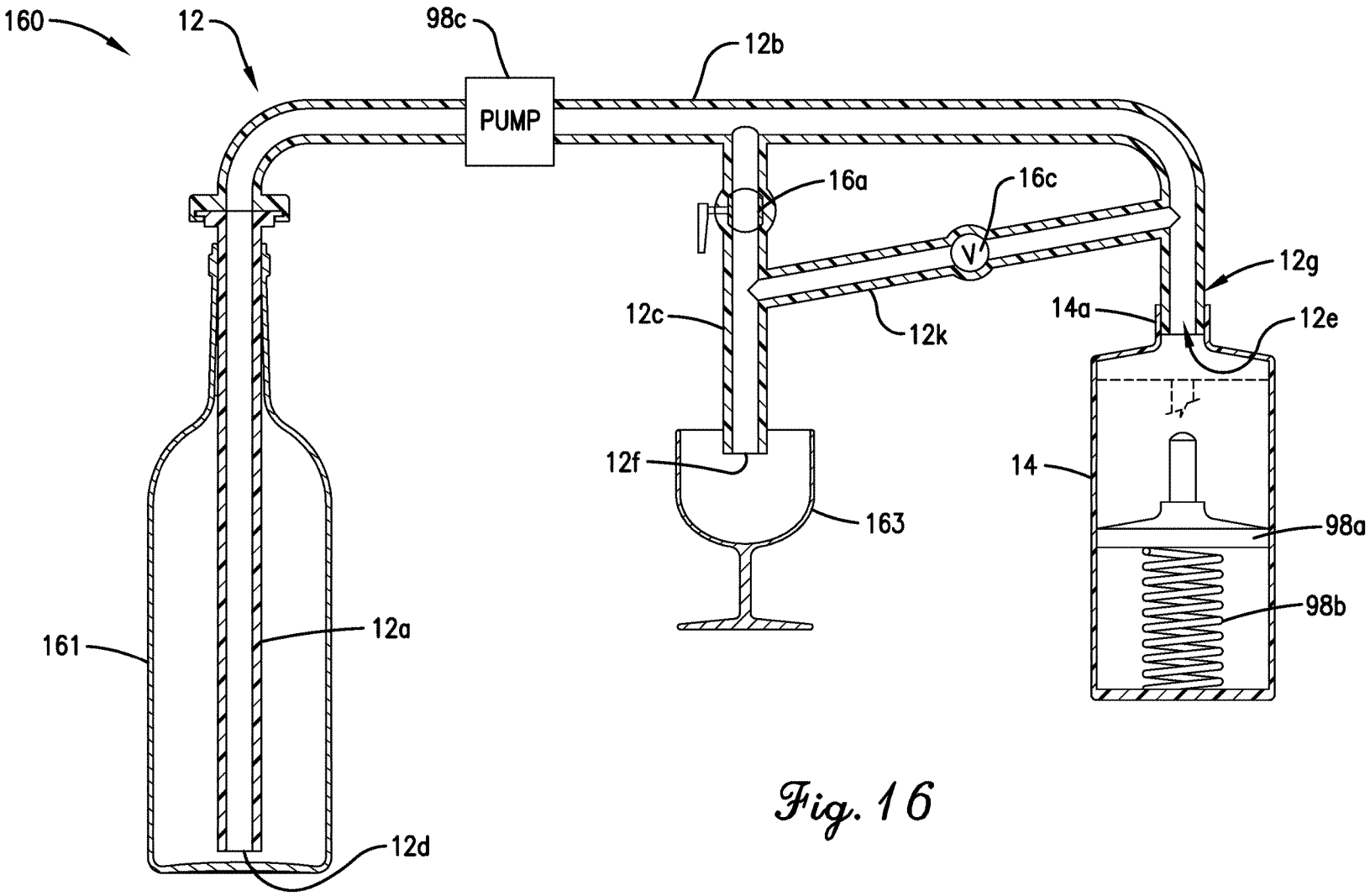
FIG. 16 is an elevational cross-sectional view of a liquid extraction apparatus in accordance with another embodiment of the present invention, particularly illustrating a liquid extraction member with a pressure relief section.

FIG. 16 depicts another embodiment of a liquid extraction apparatus 160 in accordance with the present invention. The liquid extraction apparatus 160 can be used with any liquids or any containers, such as, for example, the liquids and containers related to the liquid extraction apparatuses previously discussed. In certain embodiments, the liquid extraction apparatus 160 will be used with a container 161, which is a wine bottle and which contains wine as the liquid. As will be discussed in more detail below, the liquid extraction apparatus 160 can extract liquid from the container 161 and dispense the liquid into receptacle 163. The liquid extraction apparatus 160 of FIG. 16 may include certain of the same components and characteristics as the liquid extraction apparatuses 120 of FIG. 12. For instance, as shown in FIG. 16, the liquid extraction apparatus 160 may include liquid extraction member 12 and storage vessel 14. The liquid extraction apparatus 160 may also optionally include a valve similar to the valve shown as 16*a* of FIG. 12. However, in contrast to apparatus 120, the positioning of the storage vessel 14 and the receptacle 163 may be switched. It should be understood, though, that some embodiments of the liquid extraction apparatus 160 may provide for the storage vessel 14 and the receptacle 163 to be positioned in the orientation shown in FIG. 12. Furthermore, instead of first and second valves 16*a,b* the liquid extraction apparatus 160 may include a single valve 16*a* in the form of a shut-off type valve. The valve 16*a* may be integrated with the dispenser section 12*c*. In addition, the apparatus 160 may include a pressure relief path 12*k* extending between the transference section 12*b* and the dispenser section 12*c*. Optionally, however, the pressure relief path might also extend from the transference section 12*b* and empty directly into the receptacle 163.

In more detail, the pressure relief section 12*k* may have an inlet extending from the extraction member 12 at any position between the pump 98*c* and the liquid extraction outlet 12*e*. The pressure relief section 12*k* may extend to an outlet, which extends from the dispenser section 12*c* between the valve 16*a* and the liquid dispensing outlet 12*f* of the dispenser section 12*c*. However, the pressure relief section 12*k* may have an outlet that is not connected to the liquid extraction member 12, but that empties directly into the receptacle 163. In some embodiments, the inlet of the pressure relief section 12*k* may be positioned at a higher elevation than the outlet of the pressure relief section 12*k*. The pressure relief section 12*k* includes a valve 16*c* in the form of a pressure relief valve, positioned therein. The valve 16*c* may be configured to prevent liquid from flowing from the inlet to the outlet of the pressure relief section 12*k* unless a cracking pressure exists between the inlet and the outlet. The cracking pressure may be selected as necessary for particular application, but may, in some embodiments be between 25 and 5 p.s.i., between 20 and 10 p.s.i., or about 15 p.s.i.

In operation of the apparatus 160, the extraction section 12*a* of the extraction member 12 can be inserted into the container 161 so that the extraction inlet 12*d* is positioned below the surface of the liquid in the container 161. In some embodiments, the liquid extraction apparatus 160 may include a container connection (not shown in FIG. 160), which is similar to the container connection 69 of liquid extraction apparatus 60. The container connection may comprise a stopper with a through-hole for receiving the extraction section 12*a* and for keeping the extraction section 12*a* aligned within the container 161. In some embodiments, the container connection may also include a vent hole for equalizing the air pressure within the container 161 with the ambient air pressure as liquid is removed from the container 161. Nevertheless, to continue operation, the valve 16*a* can be selectively positioned in the open position, so as to fluidly connect the pump 98*c* (e.g., an inline or_a peristaltic pump) and the liquid dispensing outlet 12*f*. As such, the pump 98*c* can pump liquid, via peristaltic action, from the container 161 through the extraction section 12*a*, through a portion of the transference section 12*b*, through/past the pump 98*c*, through the dispenser section 12*c* (including the valve 16*a*) and into the receptacle 163. While liquid is being dispensed into the receptacle 163, liquid will continue to flow simultaneously from the pump 98*c* through the remaining portions of the transference section 12*b* (i.e., the portion of the transference section 12*b* to the right of the dispenser section 12*c*, as illustrated in FIG. 16) to the connection member 12*g* to which the storage vessel 14 is connected. However, due to the force of the spring 98*b*, liquid will be prevented from flowing into the storage vessel 14. Liquid will, however, be forced through the inlet of the pressure relief section 12*k* until the liquid is impeded by the valve 16*c*. At such time, the valve 16*a* can be closed. In such a configuration, with the valve 16*a* in the closed position, the liquid extraction apparatus 160 will be in the primed configuration. In particular, the liquid extraction apparatus 160 will be in the primed configuration having liquid (and no air) held within the extraction section 12*a*, within the transference section 12*b*, and within the connection member 12*g* (up to the storage vessel 14).

With the liquid extraction apparatus 160 in the primed configuration, including with the valve 16*a* in the closed position, the pump 98*c* can pump liquid from the container 161 into the storage vessel 14. Initially, the base portion 98*a* of the pressure differential device 98 will be positioned within the storage vessel 14, with the base portion 98*a* positioned adjacent to the connection member 14*a* (as shown in broken line in FIG. 16). As such, the pump 98*c* can pump liquid, via peristaltic action, from the container 161, through the extraction section 12*a*, through a portion of the transference section 12*b*, through/past the pump 98*c*, bypass the dispenser section 12*c* (due to the valve 16*a* being closed), through the connection member 12*g*, and into the storage vessel 14. As liquid begins to flow into the storage vessel 14, the liquid under pressure from the pump 98*c* causes the base portion 98*a* to shift away from the connection member 14*a*, thereby causing the spring 98*b* to compress. Beneficially, the storage vessel 14 is filled with liquid that has not been exposed to the external environment (e.g., air). The storage vessel 14 will continue to be filled until it is full. At such time, the pressure within the pressure relief section 12*k* will increase to a level exceeding the cracking pressure of the valve 16*c*, such that liquid will begin to flow from the container 161, through the pressure relief section 12*k*, and to the receptacle 163. The remaining liquid from the container 161 can be sent through the pressure relief section 12*k* to the receptacle 163 for immediate consumption. Upon the container 161 being emptied and the pump 98*c* being turned off, the liquid that was filled in the vessel 14 will be prevented from leaving the storage vessel 14 by the pump 98*c* (which may be configured to prevent liquid from flowing back to the container 161), the valve 16*a*, and the valve 16*c* and optionally by a valve similar to valve 16*a* of FIG. 12.

The liquid extraction apparatus 160 can be configured in a manner so as to permit the entire contents or a portion of the contents of a specific container 161 to be stored within the vessel 14 and/or extracted into the receptacle 163. For example, when the container 161 is a wine bottle, the liquid extraction apparatus 160 may be configured to initially store all but one glass of liquid from the wine bottle within the vessel 14, such that the remaining one glass of liquid can be sent to the receptacle 163, via pressure relief section 12*k*, for immediate consumption. In addition, pressure relief section 12*k* may be operable to act as a safety mechanism to provide a safety outlet for liquid to flow during an overpressure within the liquid extraction apparatus 160.

With the storage vessel 14 filled with liquid, the liquid extraction apparatus 160 is operable to either (1) further dispense liquid from the storage vessel 14 into the receptacle 163, or (2) store the liquid within the storage vessel 14 for future dispensing. To further dispense the liquid, the valve 16*a* can be shifted to the open position, thereby causing the base portion 98*a* to be shifted toward the connection member 14*a*, via the force of the spring 98*b*, to expel liquid stored within the storage vessel 14 through the connecting member 12*g*, through a portion of the transference section 12*b*, through the dispenser section 12*c*, and into the receptacle 163. It is understood that the valve 16*c* prevents the liquid stored within the vessel 14 from passing through the pressure relief section 12*k* unless the cracking pressure is achieved between the inlet and the outlet of the pressure relief section 12*k*. The valve 16*a* may be held open until the entire amount of liquid within the storage vessel 14 has been dispensed, or alternatively, at any time during the dispensing of the liquid from the storage vessel 14, the valve 16*a* can be closed so as to cut-off the liquid from being dispensed from the storage vessel 14. With the valve 16*a* in the closed position, the base portion 98*a* will remain generally in a stationary position, with the pressure of the liquid within the storage vessel being counterbalanced by the force of the spring 98*b* and the pump 98*c*, the valve 16*a*, and/or the valve 16*c*.

To store the liquid within the storage vessel 14 for future dispensing, the storage vessel 14 can be removed from the extraction member 12, similar to the liquid extraction apparatuses previously described herein. In such embodiments, a seal device may be placed into or onto connection member 14*a* to block air from contacting the liquid and/or to block the liquid from exiting the storage vessel 14. Any type of common seal device can be used, such as, for example, a rubber or silicone stopper, a plug, a threaded cap, a selectively-actuated valve, or the like. Alternatively, a dispensing topper 126, as previously describe, may be used. Once the storage vessel 14 has been removed from the extraction member 12, a seal device may be placed into or onto connection member 12*g* to block air from contacting the liquid and/or to block the liquid from exiting the extraction member 12. Any type of common seal device can be used, such as, for example, a rubber or silicone stopper, a plug, a selectively-actuated valve, or the like. As such, the storage vessel 14 can be removed, such that the liquid within the storage vessel 14, which has not been in contact with the external environment (e.g., air), can be stored for an extended period, such as weeks, months, or years. To thereafter dispense the liquid stored in the removed storage vessel 14, the seal device can be removed from the storage vessel 14 and/or the dispensing topper 126 may be actuated, such that the spring 98*b* can actuate the base portion 98*a* towards the connection member 14*a* to force some or all of the liquid out through the through-opening of connection member 14*a* and/or through the dispensing topper 126. In some alternative embodiments, the base portion 98*a* and/or the spring 98*b* of the pressure differential device 98 can be removed from the storage vessel 14 and the liquid can be poured from the storage vessel 14.

It is the inventor's intent to rely on the Doctrine of Equivalents to determine and assess the reasonably fair scope of the present invention as it pertains to any processes and systems not materially departing from but outside the literal scope of the invention as set forth in the following claims. For example, the liquid extraction apparatus 90 of FIG. 9 may alternatively be configured to operate with a single on/off type valve, as opposed to the multi-port valve 96. In particular, the on/off valve may be positioned within the transference section 12*b* between the connection member 12*g* and the dispenser section 12*c*. To operate such an embodiment of a liquid extraction apparatus, the on/off valve may initially be configured in the open position and the pump 98*c* can pump liquid from the container 91 to the receptacle 93. Due to the force of the spring 98*b* against the base portion 98*a*, the liquid will be prevented from flowing into the storage vessel 14. Once an intended amount of liquid has been dispensed into the receptacle 93, the on/off valve can be closed, such that the pump 98*c* can pump liquid (without any air) from the container 91 into the storage vessel 14. Liquid from the storage vessel 14 can then be dispensed from the storage vessel 14 by opening the on/off valve (with the storage vessel 14 being attached to the extraction member 12). In such embodiments, the pump 98*c* will function to prevent liquid from flowing back into the container 91. Alternatively, the storage vessel 14 can be removed from the extraction member 12, and liquid can be dispensed from the storage vessel 14 by one or more of the procedures previously described.

In additional alternative embodiments of the liquid extraction apparatus described in the preceding paragraph, the pump 98*c* may be replaced with an air pump in communication with the container 91, such as air pump 88*d* illustrated with respect to the liquid extraction apparatus 80 illustrated in FIG. 8. In such embodiments, the liquid extraction apparatus may include an additional one-way check valve positioned within the transference section 12*b* between the storage vessel 14 and the container 91 so as to prevent liquid added to the storage vessel 14 from being forced out of the storage vessel 14 (under the force of the spring 98*b*) back into the container 91. In still additional alternative embodiments of the liquid extraction apparatus described above, the spring 98*b* may be removed from the storage vessel 14 and the liquid extraction apparatus may be used to dispense liquid into the receptacle 93 and to fill the storage vessel 14 in the manner previously described. In such embodiments, a check valve may not be required between the storage vessel 14 and the container 91. However, because the storage vessel 14 does not include the spring 98*b*, the storage vessel 14 may have to be removed from the extraction member 12 to dispense the liquid stored therein. In still further alternative embodiments, the liquid extraction apparatus 30 illustrated in FIG. 3 may be alternatively configured with an air pump in communication with the container 31, such as the air pump 68*d* of the liquid extraction apparatus 60 shown in FIG. 6. In such a configuration, the plunger within the storage vessel 14 may be replaced with a base portion 98*a* and a spring 98*b* as shown in liquid extraction apparatus 90 of FIG. 9. The storage vessel 14 may be filled by activating the air pump so as to force liquid from the container 31 into the storage vessel 14. Thereafter, the storage vessel 14 may be removed from the remaining portions of the liquid extraction apparatus 30 so as to dispense liquid from the storage vessel 14 pursuant to procedures previously described.

As further examples of alternative embodiments, certain of the valves described herein may be replaced with QD (i.e., quick disconnect) couplers. As previously described, QD couplers may be configured to restrict liquid flow when disconnected. As such, for example, the one-way check valve 36 of liquid extraction apparatus 30 of FIG. 3 may be replaced with a QD coupler on the second end 32*c* of the liquid extraction section 32. As such, when the storage vessel 14 is removed from the liquid extraction section 32, the QD coupler of the liquid extraction section 32 prevents liquid from falling back into the container 31 due to the liquid-flow restricting and pressure-maintaining effects of the valve QD coupler. Thus, via the QD coupler, the liquid extraction section 32 can remain in a "primed configuration." Similarly, certain embodiments may provide for a include a QD coupler associated with its connecting member 14*a* to prevent liquid from escaping from the storage vessel 14 when the storage vessel 14 is disconnected from a liquid storage apparatus. Such a QD coupler could, in some embodiments, replace the stop shut-off valve 99 described above and illustrated in FIG. 9.

Finally, embodiments of the present invention may include a cleaning process whereby components of the liquid extraction apparatus can be cleaned/sanitized before and/or after the apparatus has been used to extract, store, and/or dispense wine or other fluids. To perform such a cleaning process, water, sanitizer, or mixtures thereof may be passed through the liquid extraction apparatus to clean the components thereof. In embodiments in which components of the liquid extraction apparatus are modular, such components may be separated and cleaned individually. In other embodiments, the process for extracting wine from a wine bottle (as described above) may be similarly used to extract water (and/or sanitizer) from a water source, with such water being used to clean the liquid extraction apparatus. For example, with reference to the liquid extraction apparatus 10 of FIG. 1, the extraction section 12*a* of the liquid extraction member 12 may be inserted into the water source and water may be extracted into the liquid extraction member 12 and/or into the storage vessel 14 in a manner similarly described with respect to wine. Furthermore, the water that was extracted into the liquid extraction member 12 and/or storage vessel 14 can be dispensed therefrom (i.e., through the liquid dispensing section 12*c*). As such, the liquid extraction apparatus 10 can be cleaned and sanitized through use of water and/or sanitizer being passed therethrough. However, it should be understood that in some embodiments, other components (e.g., conduits, pumps, valves, etc.) may be used with the liquid extraction apparatus to assist with the performance of the cleaning and/or sanitizing the apparatus.

What is claimed is:

1. A system for extracting a liquid from a container having an opening, said system comprising:

a liquid extraction member including a liquid extraction inlet and one or more liquid extraction outlets, and wherein said liquid extraction member is configured for insertion through the opening of the container and for positioning of said extraction inlet below a surface of the liquid, one or more storage vessels each defining a liquid storage inlet coupled in fluid flow communication with said extraction member via one of said liquid extraction outlets, wherein each of said storage vessels comprises a variable internal storage volume;

a pressure differential device operable to cause liquid to flow from the container, through said liquid extraction member, and into one or more of said storage vessels; and one or more fluid restrictors associated with said liquid extraction member and configured to prevent fluid flow in at least one direction through said liquid extraction member to prevent liquid in said liquid extraction member from receding from said liquid extraction member back into the container, wherein said liquid extraction member further comprises a liquid dispenser section, and wherein said system is configured to be capable of directing liquid to flow either into one or more of said storage vessels or through said liquid dispenser section, wherein said system comprises one or more valves configured to be capable of directing the liquid to flow either into one or more of said storage vessels or through said dispenser section, where said one or more storage vessels are each rigid and formed at least partially from glass, plastic, or metal, and wherein each of said one or more storage vessels includes a shiftable barrier received within said storage vessel and configured to provide a fluid seal within said storage chamber, so as to prevent air and/or liquid from passing from a first side of said shiftable barrier to a second side of said shiftable barrier, wherein said system includes a pressure relief section comprising a pressure relief inlet and a pressure relief outlet, wherein said pressure relief section is configured to permit passage of liquid and/or air when a pressure between said pressure relief inlet and said pressure relief outlet reaches a cracking pressure.

2. The system according to claim 1, wherein said fluid restrictor comprises a valve.

3. The system according to claim 2, wherein said valve comprises a one-way check valve.

4. The system according to claim 1, wherein said fluid restrictor comprises a pump.

5. The system according to claim 4, wherein said pump comprises a peristaltic pump.

6. The system according to claim 1, wherein the liquid is wine and the container is a wine bottle.

7. The system according to claim 1, wherein said pressure differential device comprises at least one of said shiftable barriers received within at least one of said storage vessels, wherein shifting of said at least one shiftable barrier changes the internal storage volume of said at least one storage vessel, wherein at least one of said one or more fluid restrictors is positioned between said liquid extraction inlet and said liquid extraction outlet associated with said at least one storage vessel.

8. The system according to claim 7, wherein the liquid is wine and the container is a wine bottle.

9. The system according to claim 8, wherein at least one of said storage vessels is detachable from said liquid extraction member.

10. The system according to claim 7, wherein said at least one shiftable barrier is configured to be shifted by an actuator selected from one or more of the following: a linear actuator, a rotary actuator, an air pump, a hydraulic pump, a mechanical spring, an air spring, or a manual actuator.

11. The system according to claim 7, wherein said liquid dispenser section presents a liquid dispensing outlet, and wherein said system further includes an additional at least one fluid restrictor associated with said liquid extraction member and positioned between said one or more storage vessels and said liquid dispensing outlet, with said additional at least one fluid restrictor being configured to permit liquid and/or air to flow through said liquid dispenser section in a first direction out of said liquid dispensing outlet and capable of preventing liquid/or air to flow through said liquid dispenser section to one or more of said extraction outlets in a second direction opposite of the first direction.

12. The system according to claim 11, wherein said additional at least one fluid restrictor is selected from one or more of the following: a multi-way valve, a shut-off valve, and one-way check valve.

13. The system according to claim 1, wherein said shiftable barrier includes a plug element configured to be at least partially received within said liquid extraction outlet of said liquid extraction member.

14. The system according to claim 1, where said shiftable barrier is configured to be actuated by an actuator.

15. The system according to claim 14, wherein said actuator is selected from one or more of the following: a linear actuator, a rotary actuator, an air pump, a hydraulic pump, a mechanical spring, an air spring, and a manual actuator.

16. The system according to claim 15, wherein said storage vessels are detachable from said liquid extraction member, wherein said storage vessels are each configured to seal liquid within said storage vessel and to selectively dispense liquid from said storage vessel.

17. The system according to claim 16, wherein the liquid is wine and the container is a wine bottle.

18. The system according to claim 16, wherein at least one of said storage vessels includes a dispensing topper attachable to said storage vessel for selectively dispensing liquid from said storage vessel.

19. The system according to claim 18, wherein said actuator comprises a mechanical spring in contact with to said shiftable barrier on a side of said shiftable barrier opposite to the side of the shiftable barrier that is configured to be in contact with the liquid stored within said storage vessel.

20. The system according to claim 1, wherein said pressure relief outlet of said pressure relief section is connected to said liquid dispenser section.

21. The system according to claim 20, wherein the liquid is wine and the container is a wine bottle.

* * * * *